US012742358B1

(12) United States Patent
Melsheimer et al.

(10) Patent No.: US 12,742,358 B1
(45) Date of Patent: Sep. 22, 2026

(54) UNDERGROUND DIRECTIONAL DRILLING APPARATUS

(71) Applicant: Melfred Borzall, Inc., Santa Maria, CA (US)

(72) Inventors: Eric Melsheimer, Santa Maria, CA (US); Ricky Escobar, Santa Maria, CA (US)

(73) Assignee: Melfred Borzall, Inc., Santa Maria, CA (US)

( * ) Notice: Subject to any disclaimer, the term of this patent is extended or adjusted under 35 U.S.C. 154(b) by 0 days.

(21) Appl. No.: 19/087,236

(22) Filed: Mar. 21, 2025

(51) Int. Cl.

| | |
|---|---|
| ***E21B 17/046*** | (2006.01) |
| ***E21B 7/04*** | (2006.01) |
| ***E21B 10/56*** | (2006.01) |
| ***E21B 10/60*** | (2006.01) |
| ***E21B 10/62*** | (2006.01) |
| ***E21B 47/01*** | (2012.01) |
| *E21B 47/09* | (2012.01) |
| *E21B 47/13* | (2012.01) |

(52) U.S. Cl.
CPC ..... *E21B 17/0465* (2020.05); *E21B 7/046* (2013.01); *E21B 10/62* (2013.01); *E21B 47/01* (2013.01); *E21B 10/56* (2013.01); *E21B 10/602* (2013.01); *E21B 47/09* (2013.01); *E21B 47/13* (2020.05); *Y10T 403/7033* (2015.01); *Y10T 403/7035* (2015.01)

(58) Field of Classification Search
CPC .. E21B 17/04; E21B 17/046; Y10T 403/7033; Y10T 403/7035
See application file for complete search history.

(56) References Cited

U.S. PATENT DOCUMENTS 3,986,570 A * 10/1976 Stinson ..... E21B 17/046 175/320
5,931,240 A * 8/1999 Cox ..... E21B 17/046 175/398
6,148,935 A * 11/2000 Wentworth ..... E21B 7/06 166/242.6

(Continued)

OTHER PUBLICATIONS

Dictionary definition of "epitrochoid" (Year: 2025).*

*Primary Examiner* — Blake Michener
(74) *Attorney, Agent, or Firm* — Fitch, Even, Tabin & Flannery LLP

(57) ABSTRACT

The present disclosure describes systems and methods for horizontal directional drilling. In some aspects, an elongated housing includes an interior, a front, a rear, and a longitudinal axis passing through the front and rear. A sonde transmitter is mounted in the interior. Additionally, a main fluid channel extends in the interior of the housing in a direction along the longitudinal axis to permit a flow of a fluid therethrough. A connecting region is used for attaching the drilling tool to the elongated housing, wherein the connecting region comprises a projection and a pocket, at least a portion of the projection being a mating rounded polygon, the pocket being shaped and sized to mate with the projection, and wherein the mating rounded polygon is configured to transmit torque between the transmitter housing and the drilling tool. The projection is located on one of the elongated housing and the drilling tool, and the pocket is located on the other of the elongated housing and the drilling tool.

22 Claims, 30 Drawing Sheets

(56) References Cited

U.S. PATENT DOCUMENTS

| | | | | |
|---|---|---|---|---|
| 6,263,983 | B1 * | 7/2001 | Wentworth | E21B 47/01 166/242.6 |
| 6,422,782 | B1 * | 7/2002 | Wentworth | E21B 7/046 175/45 |
| 7,147,065 | B2 * | 12/2006 | Tjader | E21B 7/064 175/320 |
| 8,939,237 | B2 * | 1/2015 | Runquist | E21B 47/01 175/398 |
| 9,719,344 | B2 | 8/2017 | Melsheimer | |
| 2002/0112890 | A1 | 8/2002 | Wentworth | |
| 2014/0353045 | A1 * | 12/2014 | Zhang | E21B 17/043 175/320 |
| 2019/0264507 | A1 * | 8/2019 | Melsheimer | E21B 17/046 |
| 2020/0040668 | A1 * | 2/2020 | Slaughter, Jr. | E21B 17/043 |
| 2020/0141449 | A1 * | 5/2020 | Kochsiek | F16D 65/123 |

* cited by examiner

FIG. 10
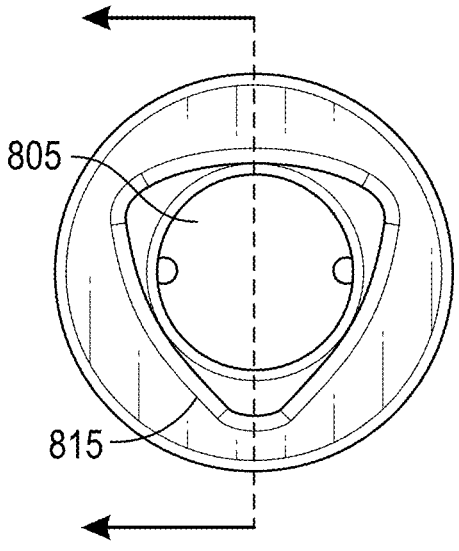
FIG. 10
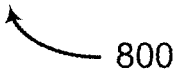
FIG. 8

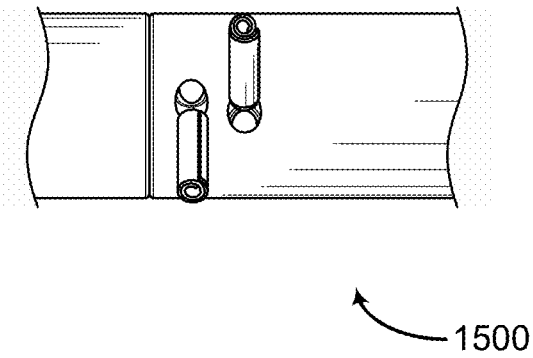
FIG. 15A
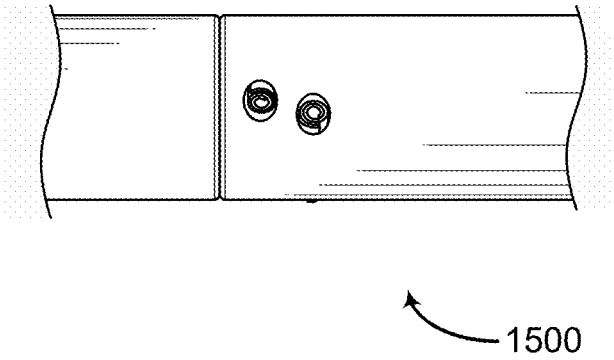
FIG. 15B
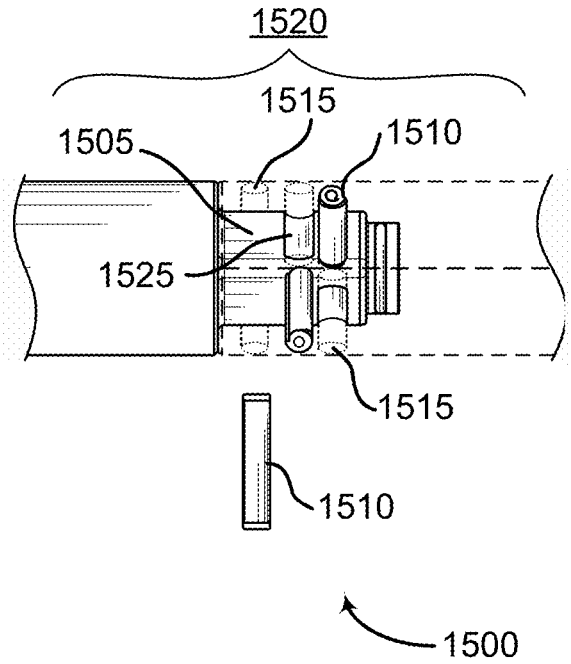
FIG. 15C
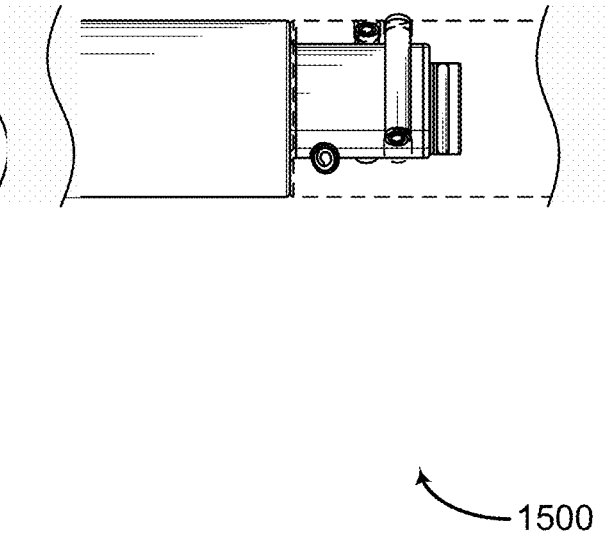
FIG. 15D
FIG. 15

UNDERGROUND DIRECTIONAL DRILLING APPARATUS

TECHNICAL FIELD

The present disclosure relates generally to underground drilling tools, and more specifically to underground directional drilling apparatus. Even more specifically, the present disclosure relates to a non-circular drilling connection for an underground directional drilling apparatus.

BACKGROUND

Horizontal Directional Drilling (HDD) is a construction method used for installing underground utilities such as cables, pipes, and conduits. In many HDD projects, a "pilot bore" is first made using a steerable drilling tool, typically consisting of a sonde housing, which may contain tracking electronics, a thread adapter attached to the proximal end of the sonde housing, and some type of drill bit attached to the distal end of the sonde housing. This combination of sonde housing, thread adapter, and drill bit may be referred to as the "drill head assembly." Typically, the thread adapter of the drill head assembly is connected to a string of drill rods. The drill rods are often between 5' and 10' in length and hollow with threaded ends. During pilot bore operations, the drill rods may be added to the drill string, one at a time, as the pilot bore proceeds further. The drill string may rotate to cut the soil and drilling fluid may be pumped through the drill rod and into the drill head assembly.

For the pilot bore step, the drill bit used is typically either a flat "paddle bit" or an "offset rock bit." The type of drill bit used is influenced by the ground conditions, drill rig capabilities, and requirements of that installation. Paddle bits are typically attached to an angled surface of the sonde housing using between 3 and 8 bolts. If the bore conditions require a different style of drill bit, such as an offset rock bit, a different sonde housing with threaded connections may be needed. The offset rock bits are typically threaded to the sonde housing. Tightening and loosening the bit from the sonde housing requires special tools and procedures.

Typically, high pressure drilling fluid is pumped from the front of the housing or bit, in the general direction of the bore path, to aid in cutting the soil and steering.

For many HDD projects, at the termination of the pilot bore, the drill head assembly is removed and a backreamer is attached. In one or more steps, the backreamer enlarges the hole to a size adequate for the pipe or conduit being installed, and drilling fluid is pumped through the backreamer to aid in the cutting of the soil, to condition the bore hole, and to provide a medium for carrying the cuttings out of the hole. The drilling fluid is typically pumped at a lower pressure and higher flow rate during backreaming than during the pilot bore drilling step. The product pipe is pulled into the reamed hole, behind the backreamer, in the "backream and pullback" step.

For installation of smaller utilities, such as telecommunications lines or small gas distribution lines, the hole created by the pilot bore drilling step may be sufficiently large for the installed product pipe without use of a backreamer. The product pipe can be attached to the drill head assembly by means of shackles, pulling eyes, or swivels which attach directly to the drill bit. This method is referred to as "direct pullback." It can be an effective method for installing smaller product pipes over shorter distances.

U.S. Publication No. 2002/0112890 and U.S. Pat. No. 8,122,989 describe some of the known drill bit designs including features designed for direct pullback. These documents are primarily directed to the attachment of the product pipe to the drill head assembly for direct pullback. However, current sonde housings and drill bits are not optimized for direct pullback. The drilling fluid is still pumped from the front of the sonde housing assembly, at high pressure and low flow rate. This is disadvantageous because the hole may be relatively dry in the backreaming direction, resulting in possible difficulties pulling back the product pipe, potentially damaging it or causing the direct pullback operation to be unsuccessful. As a result, typically, only small product pipes can successfully be installed.

Other drill head assembly designs may use a spline and pins to attach drill bits or reamers to the distal end of a sonde housing. U.S. Pat. No. 6,263,983 describes an apparatus which uses a male spline on a sonde housing and a mating female spline on a drill bit. Splines require close tolerances. HDD drilling tools are necessarily used in dirty and abrasive environments which can make spline connections difficult to assemble and disassemble. Additionally, the high impact loads caused by drilling in difficult ground conditions can cause damage to the splines, resulting in loose or even failed connections.

Still other drill head assembly designs may use a tongue and groove and pins design. One such design is described in U.S. Pat. No. 8,939,237. Such designs also suffer from being difficult to assemble and disassemble in the dirty and abrasive environments of directional drilling. Additionally, the tongue and groove design is not optimized for transmitting rotary torque.

Accordingly, what is needed is an apparatus for connecting pilot drilling and backreaming tooling to the distal end of a sonde housing that overcomes the aforementioned disadvantages associated with the known devices.

SUMMARY

Several embodiments of the disclosure advantageously address the needs above as well as other needs by providing a non-circular drilling connection for an underground directional drilling apparatus.

The present disclosure describes systems and methods for horizontal directional drilling. Embodiments of the present disclosure include a drilling assembly comprising an elongated housing with a first connecting member for attaching a drilling tool (e.g., a pulling eye, a pullback reamer, a drill bit, etc.). For example, the first connecting member includes a projection comprising a rounded polygon shape. In some cases, the drilling tool comprises a second connecting member for attachment to the elongated housing via the projection. For example, the second connecting member is a pocket comprising an internal shape similar to the rounded polygon shape of the first connecting member. In some examples, the first connecting member and the second connecting member are shaped and sized to attach the elongated housing and the drilling tool. Accordingly, embodiments of the present disclosure are able to transmit torque from the elongated housing to the drilling tool which provides for secure installation of the product pipelines.

In one embodiment, the disclosure can be characterized as an apparatus, system, and method for directional drilling apparatus. One or more aspects of the apparatus, system, and method include an elongated housing including an interior, a front, a rear, and a longitudinal axis passing through the front and rear; a sonde transmitter mounted in the interior; a main fluid channel extending in the interior of the housing in a direction along the longitudinal axis to permit a flow of a fluid therethrough; a drilling tool; and a connecting region for attaching the drilling tool to the elongated housing, wherein the connecting region comprises a projection and a pocket, at least a portion of the projection being a mating rounded polygon, the pocket being shaped and sized to mate with the projection, and wherein the mating rounded polygon is configured to transmit torque between the transmitter housing and the drilling tool, wherein the projection is located on one of the elongated housing and the drilling tool, and the pocket is located on the other of the elongated housing and the drilling tool.

In another embodiment, the disclosure can be characterized as a method, apparatus, and system for directional drilling apparatus. One or more aspects of the method, apparatus, and system include forming an elongated housing with an interior, a front, a rear, and a longitudinal axis passing through the front and rear; mounting a sonde transmitter in the interior of the housing; extending a main fluid channel in the interior of the housing along the longitudinal axis to permit a flow of fluid therethrough; and attaching a connecting member to the housing for attaching a drilling tool, wherein the connecting member comprises a projection and a pocket, at least a portion of the projection being a mating rounded polygon, the pocket being shaped and sized to mate with the projection, and wherein the mating rounded polygon is configured to transmit torque between the transmitter housing and the drilling tool.

Additional combinations and/or permutations of the above examples are envisioned as being within the scope of the present disclosure. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF DRAWINGS

The above and other aspects, features and advantages of several embodiments of the present disclosure will be more apparent from the following more particular description thereof, presented in conjunction with the following drawings.

FIG. 8 shows an example of a front view of a portion of an apparatus for horizontal directional drilling according to aspects of the present disclosure.

FIG. 15A shows an example of a side view of an unassembled two-pin threadless joint connecting region according to aspects of the present disclosure.

FIG. 15B shows an example of a side view of an assembled two-pin threadless joint connecting region according to aspects of the present disclosure.

FIG. 15C shows an example of a side view of an unassembled three-pin threadless joint connecting region according to aspects of the present disclosure.

FIG. 15D shows an example of a side view of an assembled three-pin threadless joint connecting region according to aspects of the present disclosure.

FIG. 22 shows an example of views of a portion of an apparatus for horizontal directional drilling including a female connector for a threadless joint according to aspects of the present disclosure.

Figure 1:
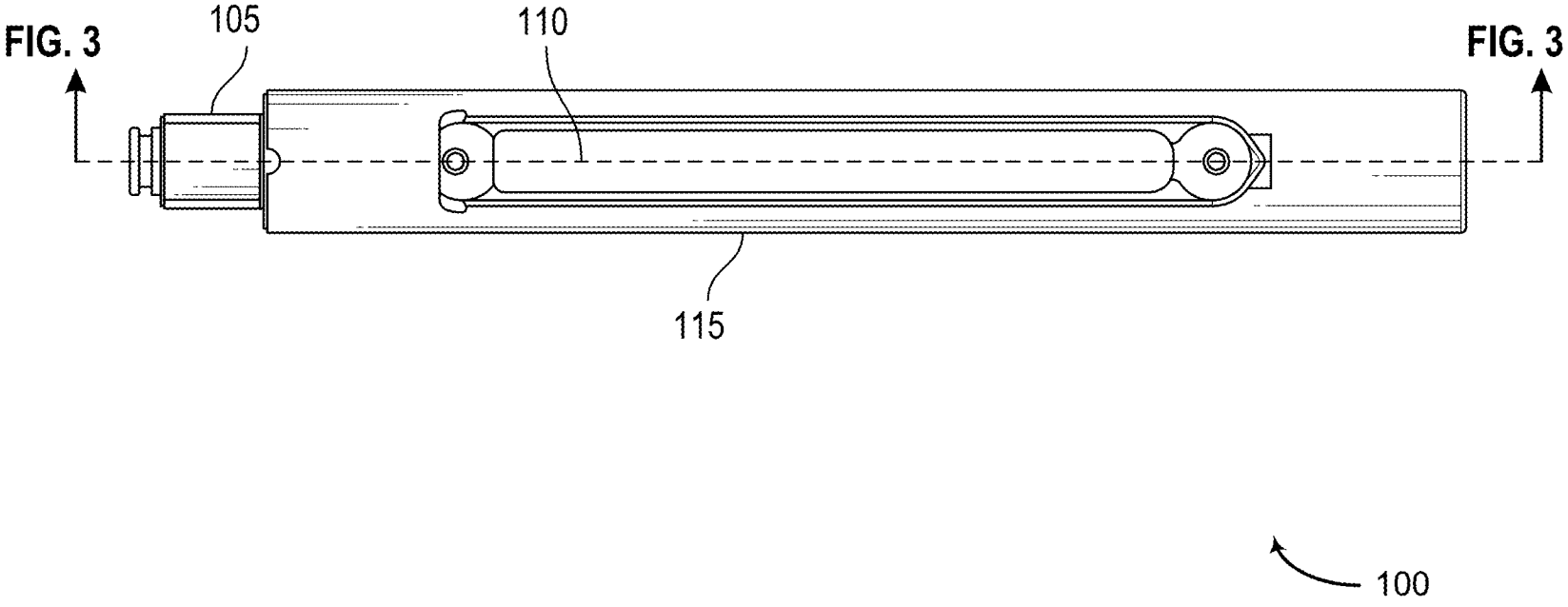
FIG. 1 shows an example of a top view of a portion of an apparatus for horizontal directional drilling according to aspects of the present disclosure.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

Recently, horizontal directional drilling (HDD) has been used to install underground utilities, including, cables, pipes, conduits, etc. The method involves initially creating a pilot bore using a steerable drilling tool for placement of the underground pipes. In some cases, the steerable drilling tool consists of a drill head assembly comprising a combination of sonde transmitter, thread adapter, and drill bit. Different types and sizes of drill bits may be used for different ground conditions and requirements. The drill head assembly is used to complete the pilot bore step, which establishes the path of the bore.

Following the pilot bore, the product pipes or conduits may be pulled back into the bore hole. For product pipes that are smaller in diameter than the pilot bore, the product pipes may be attached directly to the drill head assembly. Various systems and processes are known in the art for direct pullback. For example, shackles, pulling eyes, or swivels can be attached directly to the drill bit to perform the pullback operation. In some cases, when installing product pipes larger in diameter thana the pilot bore, the bore hole may need to be enlarged to a bigger diameter by a backreaming process. In some cases, the drill head assembly is removed and a backreamer is attached to the drill string. The backreamer cuts the bore hole to a size large enough for the product pipes to be pulled back. Removing the drill head assembly and attaching the backreamer requires specialized tools and additional space to access the tools, requiring additional time and cost.

In some cases for installing larger product pipes, the drill bit may be unconnected from the sonde housing and replaced with a backreamer that attaches to the sonde housing. In some cases, this connection is a threaded joint. This offers the advantage of not needing to remove the sonde housing and adapter. However, it still requires specialized tools and space to remove the drill bit and attach the backreamer. Additionally, the connection may not be sufficiently strong for the backreaming operation. Therefore, there is a need in the art for a connecting member that can transmit rotary torque between the sonde housing and backreamer or pilot bit, that is secure, reliable, and easy to use.

The present disclosure describes systems and methods for horizontal directional drilling. Embodiments of the present disclosure include a drilling system comprising a drilling tool and an elongated housing carrying a product pipe. In some cases, an interior region of the elongated housing includes a sonde transmitter mounted on the interior region. In some cases, the interior region of the drilling tool includes a main fluid channel that extends across a longitudinal axis of the interior region. For example, the main fluid channel is configured to enable fluid flow through the elongated housing.

Embodiments of the present disclosure include the drilling apparatus comprising the elongated housing with a connecting member for attaching the drilling tool. According to an embodiment, the connecting member is a projection. For example, the projection is a rounded polygon. In some examples, the rounded polygon may refer to a rounded triangle, a rounded quadrilateral, a rounded pentagon, etc. In some examples, a rounded polygon comprises arc-shaped sides. In some examples, a rounded polygon comprises arc-shaped vertices, wherein a radius of an arc corresponding to the vertex is less than a radius of an arc corresponding to the side.

In case of a HDD, an initial pilot bore is constructed using a steerable drilling tool. For instance, the steerable drilling tool comprises a sonde housing, a thread adapter, and a drill bit, wherein the combination of the sonde housing, the thread adapter, and the drill bit are referred to as a drill head assembly. In some examples, the sonde housing (e.g., sonde transmitter) is used to hold tracking electronics. In some examples, the drill bit is attached to a distal end of the sonde housing. In some examples, the thread adapter is attached to a proximal end of the sonde housing.

For example, the thread adapter may be connected to a string of drill rods. In some examples, the drill rods may be between 5' to 10' in length. In some examples, the drill rods may include a hollow interior region. In some examples, the drill rods may include a threaded end. In some cases, e.g., during a pilot bore operation, the drill rods may sequentially be added to the drill string. For example, the drill rods may be added one at a time to the drill string as the pilot bore proceeds further. In some examples, the drill string may be rotated to cut the soil. In some examples, the drilling fluid may be pumped through the drill rod and into the drill head assembly.

In some cases, the drill bit may be a flat paddle bit for the pilot bore operation. In some cases, the drill bit may be an offset rock bit for the pilot bore operation. In some cases, the drill bit used may be affected by factors including, but not limited to, ground conditions, drill rig capabilities, requirements of the installation. For example, a paddle bit may be attached to an angled surface of the sonde housing using approximately 3 to 8 bolts.

In some cases, the offset rock bit may be used based on the bore conditions. For instance, in case of the offset rock bit, a different sonde housing may be used with threaded connections. In some examples, the offset rock bits may be threaded to the sonde housing. As such, the offset rock bit may be tightened or loosened from the sonde housing using a predetermined tool and a predetermined procedure.

In some cases, a high pressure drilling fluid may be pumped from the front of the housing. In some cases, a high pressure drilling fluid may be pumped from the front of the drill bit. For instance, the high pressure drilling fluid may be pumped in the direction of the bore path. In some examples, the high pressure drilling fluid may be pumped to enable a process of cutting the soil. In some examples, the high pressure drilling fluid may be pumped to enable a process of steering the soil.

The process of HDD may be terminated by removing the drill head assembly and attaching a back-reamer. In some cases, the back-reamer may enlarge the hole to a size adequate for the pipe or conduit being installed. Additionally, the drilling fluid may be pumped through the back-reamer to aid in the cutting of the soil. In some cases, the drilling fluid may be pumped to condition the bore hole. Additionally, in some cases, the drilling fluid may be pumped to provide a medium for carrying the cuttings out of the hole. The drilling fluid may be pumped at a lower pressure and higher flow rate during back-reaming than during the pilot bore drilling operation. Subsequently, the product pipe may be pulled into the reamed hole. For instance, the product pipe may be pulled behind the back-reamer during the pullback reaming operation.

According to an example, in case of installation of a small utility, the hole created by the pilot bore drilling step may be sufficiently large for the installed product pipe without use of a back-reamer. For instance, the installation of the small utility may refer to utility lines such as, but not limited to, telecommunications lines or small gas distribution lines. In some examples, the product pipe may be attached to the drill head assembly for a direct pullback operation. For instance, the product pipe may be attached to the drill head assembly via the drill bit by means of tools such as shackles, pulling eyes, or swivels. In some cases, direct pullback may be effective in installing small product pipes over short distances.

For installing product pipes larger in diameter than the pilot bore, the direct pullback operation may not be optimal. In some cases, the drill head assembly is removed after the pilot bore and a backreamer is attached to the drill string. The backreamer is sized to cut a hole large enough for the product pipes to be pulled back. Removing the drill head assembly and attaching the backreamer requires specialized tools and additional space to access the tools, requiring additional time and cost. In some cases for installing larger product pipes, the drill bit may be unconnected from the sonde housing and replaced with a backreamer that attaches to the sonde housing. In some cases, this connection is a threaded joint. This offers the advantage of not needing to remove the sonde housing and adapter. However, it still requires specialized tools and space to remove the drill bit and attach the backreamer. Additionally, the connection may not be sufficiently strong for the backreaming operation.

In some cases, a drill head assembly may use a spline and a pin to attach a drill bit or a reamer to a distal end of the sonde housing. For instance, a spline may use a close tolerance. In some cases, an HDD drilling tool is used in a dirty environment. In some cases, an HDD drilling tool is used in an abrasive environment. As a result, the spline connections in the HDD drilling tool may be difficult to assemble and disassemble. Additionally, a high impact load caused by drilling in difficult ground conditions may cause damage to the splines resulting in a loose or a failed connection in the drill bit assembly.

In some cases, a drill head assembly may use a tongue, and a groove and pins. For instance, use of the tongue, and the groove and pins may result in difficulty in assembling and disassembling in the dirty and abrasive environment during the HDD operations. Additionally, the tongue and groove with the pins may not be optimized for transmitting rotary torque between the sonde housing and the drill bit.

Accordingly, by providing a sonde housing with a connecting member comprising a projection and a drill bit with another connecting member comprising a pocket, embodiments of the present disclosure are able to efficiently transmit rotary torque between the sonde housing and the drill bit. Additionally, embodiments are able to create a stable connection between the drilling tool and the elongated housing which enables successful underground installation of a product pipe.

The above and other aspects, features and advantages of several embodiments of the present disclosure will be more apparent from the following more particular description thereof, presented in conjunction with the following drawings.

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present description. Thus, appearances of the phrases "in one embodiment," "in an embodiment," and similar language throughout this specification may, but do not necessarily, all refer to the same embodiment.

Furthermore, the described features, structures, or characteristics of the description may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the description. One skilled in the relevant art will recognize, however, that the teachings of the present description can be practiced without one or more of the specific details, or with other methods, components, materials, and so forth. In other instances, well-known structures, materials, or operations are not shown or described in detail to avoid obscuring aspects of the description.

A Drilling Apparatus

FIG. 1 shows an example of a top view of a portion of an apparatus for horizontal directional drilling 100 according to aspects of the present disclosure. Portion of apparatus for horizontal directional drilling 100 is an example of, or includes aspects of, the corresponding element described with reference to FIGS. 2-23, 25, and 27-29.

In one aspect, portion of an apparatus for horizontal directional drilling 100 includes male connector projection 105 and elongated housing 115. In one aspect, projection 105 is attached to an exterior front region of elongated housing 115. Projection 105 forms the male connector of the connecting region of the apparatus which includes the threadless joint. The male connector mates with the female connector of the connecting region to form the threadless joint. Projection 105 is an example of, or includes aspects of, the corresponding element described with reference to FIGS. 2-3, 6, 14, 16, 18, 19, and 23-25. While the projection 105 is shown connected to the elongated housing 115, it will be understood that the connectors may be switched and the female connector connected to the elongated housing instead.

In one aspect, elongated housing 115 includes a cavity or recess 110 configured to receive a sonde transmitter. According to some aspects, a sonde transmitter is mounted in the interior of the elongated housing 115. In some aspects, the sonde transmitter is configured to transmit data related to the position and orientation of the drilling tool. Elongated housing 115 is an example of, or includes aspects of, the corresponding element described with reference to FIGS. 2-3, 7, 19-20, 23-25, and 27.

Figure 2:
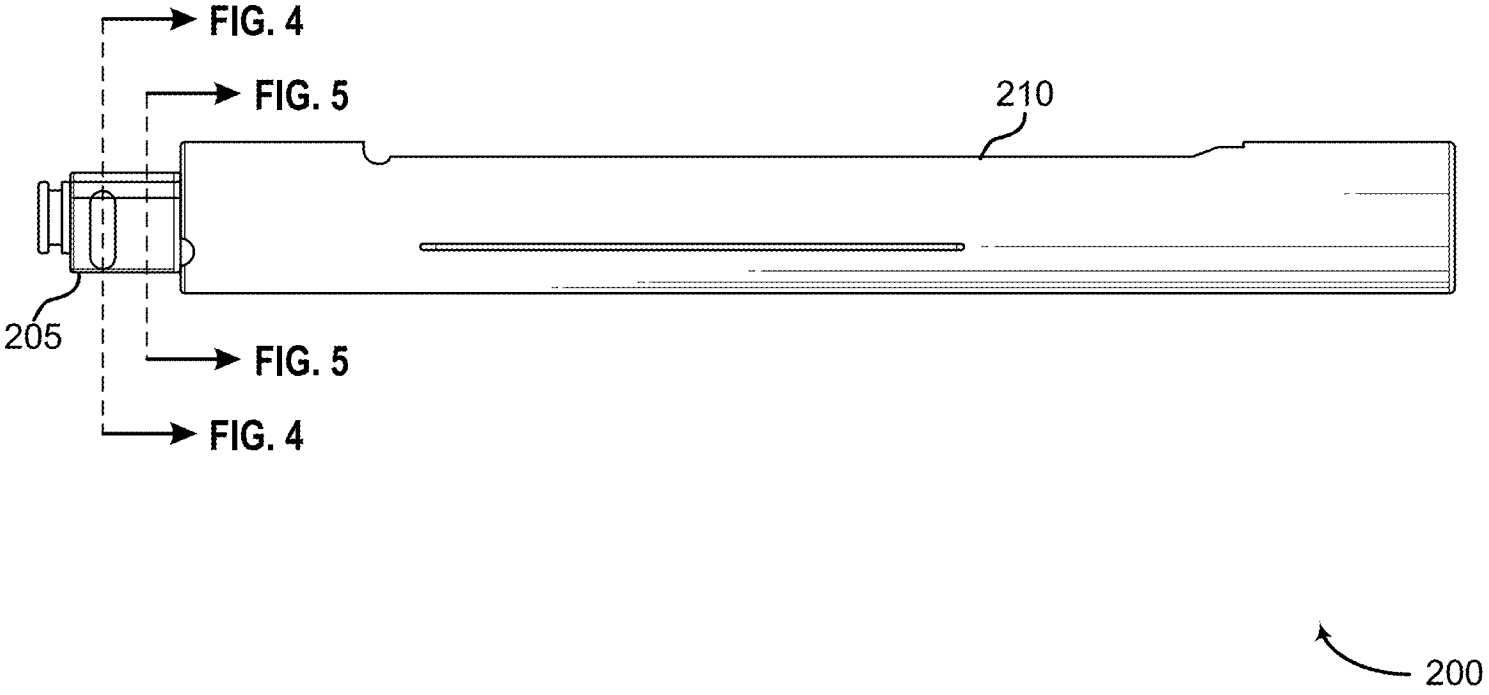
FIG. 2 shows an example of a side view of the portion of the apparatus according to aspects of the present disclosure.

FIG. 2 shows an example of a side view of a portion of an apparatus for horizontal directional drilling 200 according to aspects of the present disclosure. Portion of apparatus 200 is an example of, or includes aspects of, the corresponding element described with reference to FIGS. 1, 3-23, 25, and 27-29.

As shown with reference to FIG. 2, portion of apparatus 200 includes projection 205 and elongated housing 210. For instead, FIG. 2 indicates a side view as illustrated in FIG. 1. Projection 205 is an example of, or includes aspects of, the corresponding element described with reference to FIGS. 1, 3, 6, 14, 16, 18, 19, and 23-25. Elongated housing 210 is an example of, or includes aspects of, the corresponding element described with reference to FIGS. 1, 3, 7, 19, 20, 23-25, and 27.

Figure 3:
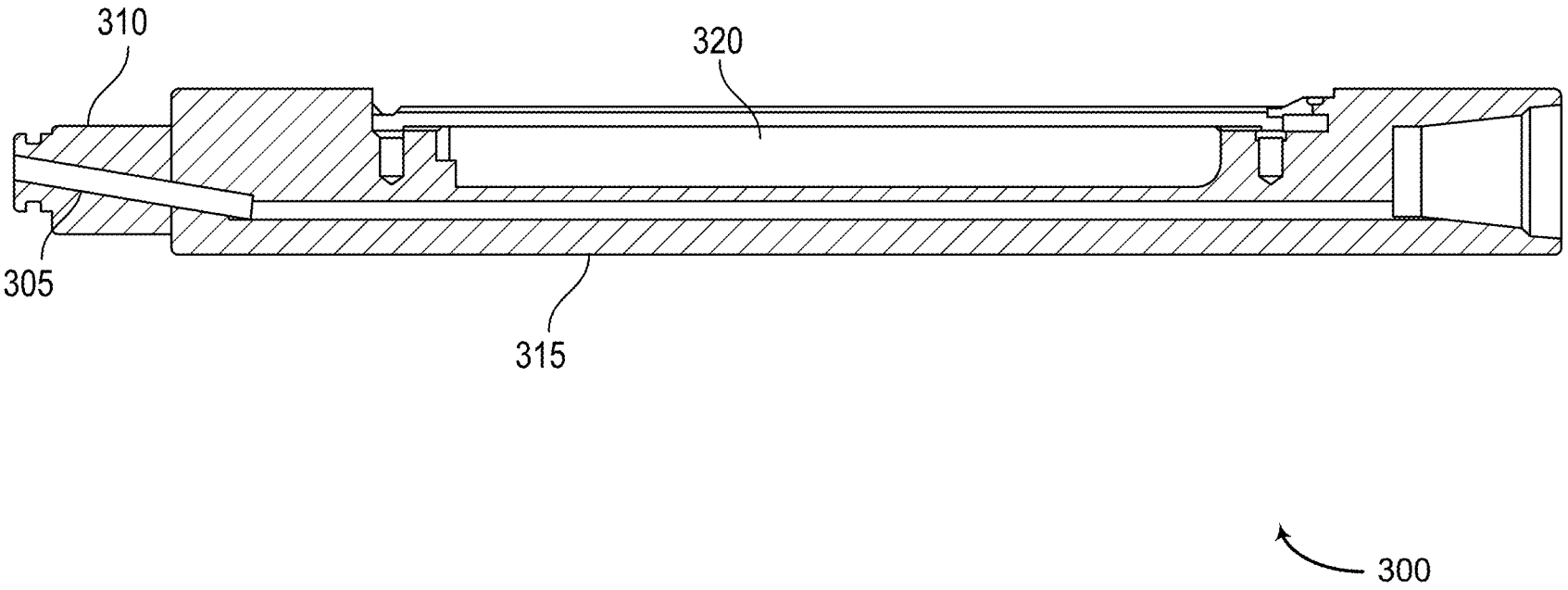
FIG. 3 shows an example of a side section view of the portion of the apparatus according to aspects of the present disclosure.

FIG. 3 shows an example of a side section view of a portion of an apparatus for horizontal directional drilling 300 according to aspects of the present disclosure. For instance, FIG. 3 indicates a side section view as illustrated in FIG. 1.

In one aspect, projection 605 comprises main fluid channel 615, as described with reference to FIGS. 4-5. Main fluid channel 615 is an example of, or includes aspects of, the corresponding element described with reference to FIGS. 4, 5, 7, 9-12, and 16.

According to some aspects, main fluid channel 305 is extending in the interior of the elongated housing 315 in a direction along the longitudinal axis to permit a flow of a fluid therethrough. Main fluid channel 305 is an example of, or includes aspects of, the corresponding element described with reference to FIGS. 6, 8, and 18.

According to an aspect, connecting region is a region of connection between the projection and a pocket, such as projection 105 described with reference to at least FIG. 1 and pocket 805 described with reference to at least FIG. 8. According to an aspect, connecting region is a region that encompasses a joint connecting two elements together for operation as a single apparatus. In some embodiments, the joint is a threadless joint. In some cases, connecting region refers to an assembled state of the projection and the pocket, forming a joint between an element having a projection and an element having a pocket. Connecting region is an example of, or includes aspects of, the corresponding element described with reference to FIGS. 7, 15, 16, and 19-29.

Figure 4:
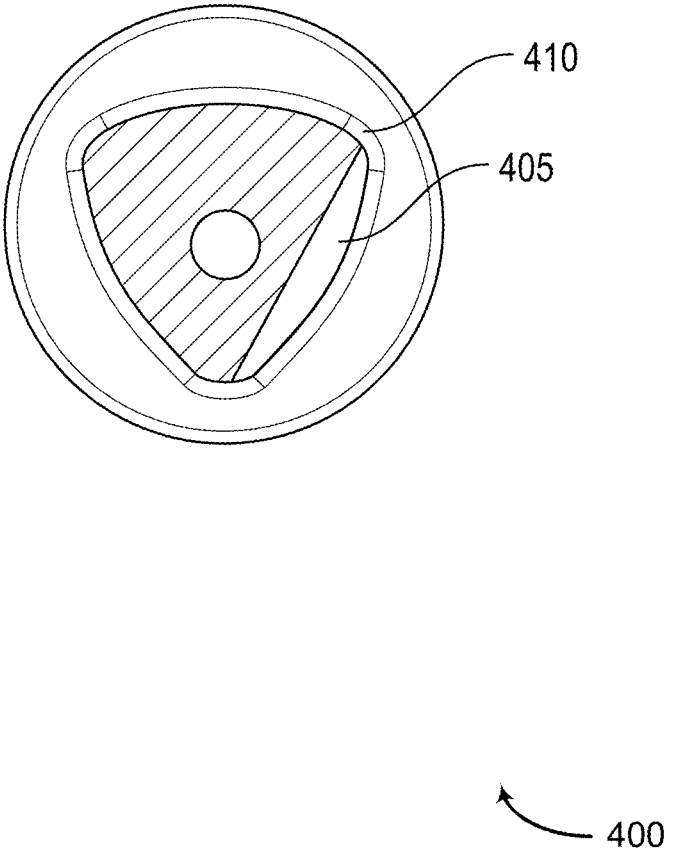
FIGS. 4 through 5 show examples of a front section view of the portion of the apparatus according to aspects of the present disclosure.

FIG. 4 shows an example of a front section view of a portion of the apparatus for horizontal directional drilling 400 according to aspects of the present disclosure. For instance, FIG. 4 indicates a front section view as illustrated in FIG. 2.

Portion of the apparatus 400 is an example of, or includes aspects of, the corresponding element described with reference to FIGS. 1-3, 5-23, 25, and 27-29.

In one aspect, portion of the apparatus 400 includes a projection 410, as described with reference to at least FIGS. 1-3. In some cases, the retention slot 405 may be present on the projection 410, such as projection 105 described with reference to FIG. 1. As shown in FIG. 4, retention slot 405 is a groove on the projection 410. Retention slot 405 is an example of, or includes aspects of, the corresponding element described with reference to FIGS. 5-7, 9-12, and 16.

In one aspect, projection 410 is a triangular feature (i.e. has a generally triangular-shaped cross-section) and comprises retention slot 405. In one aspect, projection is a rounded polygon (i.e., has a polygonal cross-section with rounded vertices and/or curved sides). In one aspect projection is a three-lobed epitrochoid (i.e. has the cross-sectional shape of a three-lobed epitrochoid). Projection 410 is an example of, or includes aspects of, the corresponding element described with reference to FIGS. 5-6.

Figure 5:
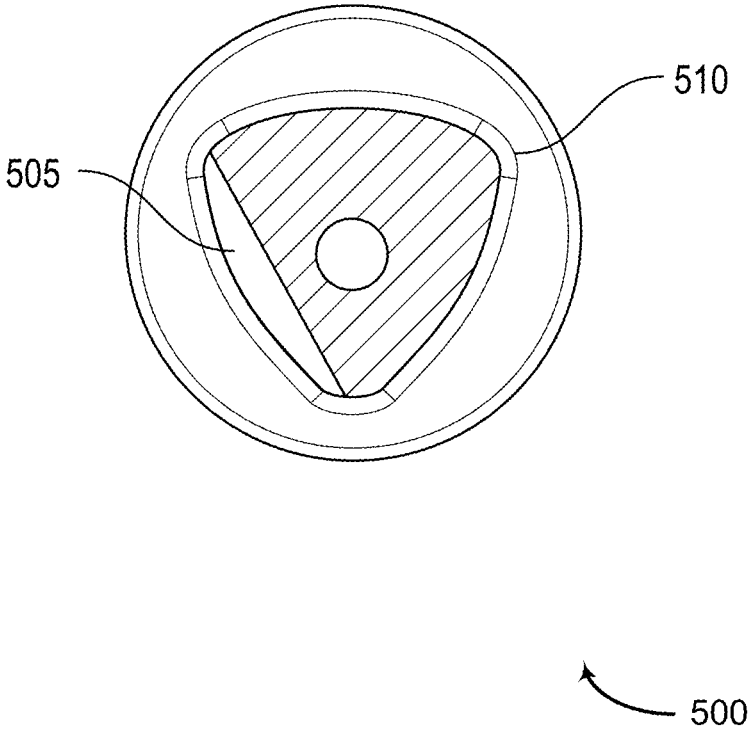

FIG. 5 shows an example of a front section view of a portion of the apparatus for horizontal directional drilling 500 according to aspects of the present disclosure. For instance, FIG. 5 indicates a front section view as illustrated in FIG. 2.

Portion of the apparatus for horizontal directional drilling 500 is an example of, or includes aspects of, the corresponding element described with reference to FIGS. 1-4, 6-23, 25, and 27-29.

In one aspect, portion of apparatus 500 includes a projection 510, as described with reference to at least FIGS. 1-3. In some cases, retention slot 505 may be present on the projection 510. As shown in FIG. 5, retention slot 505 is a groove on the projection. Retention slot 505 is an example of, or includes aspects of, the corresponding element described with reference to FIGS. 4, 6, 7, 9-12, and 16.

In one aspect, projection 510 includes a triangular feature (i.e. has a generally triangular-shaped cross-section) and comprises retention slot 505. Triangular feature 510 is an example of, or includes aspects of, the corresponding element described with reference to FIGS. 4 and 6.

Figure 6:
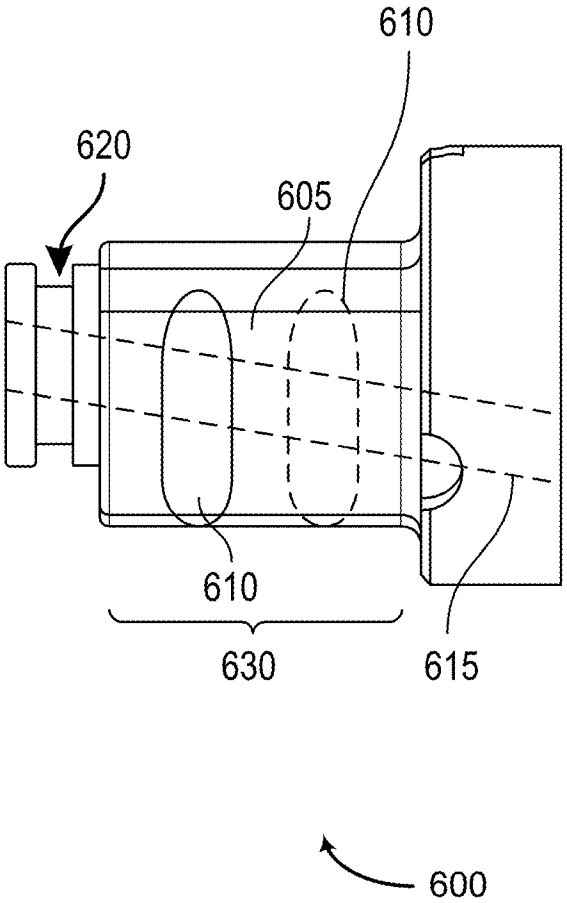
FIG. 6 shows an example of a side view and a front view of the portion of the apparatus according to aspects of the present disclosure.
Figure 6:
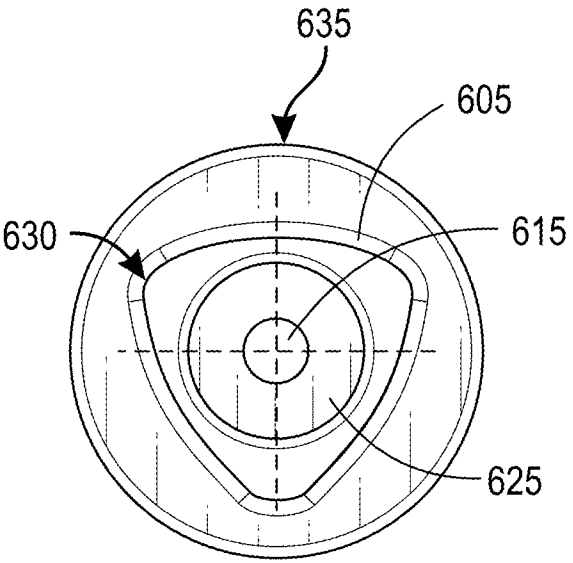

FIG. 6 shows an example of front and side views of a portion of the apparatus for horizontal directional drilling 600 according to aspects of the present disclosure. For instance, FIG. 6 indicates a front section view as illustrated in FIG. 2.

Portion of the apparatus for horizontal directional drilling 600 is an example of, or includes aspects of, the corresponding element described with reference to FIGS. 1-5, 7-23, 25, and 27-29.

In one aspect, portion of apparatus 600 includes projection 605, retention slot 610, main fluid channel 615, o-ring groove 620, round feature 625, triangular feature 630, and small groove 635.

Projection 605 is an example of, or includes aspects of, the corresponding element described with reference to FIGS. 1-3, 14, 16, 18, 19, and 23-25. In one aspect, projection 605 comprises retention slot 610. retention slot 610 is an example of, or includes aspects of, the corresponding element described with reference to FIGS. 3, 8, and 18.

In one aspect, projection 605 comprises main fluid channel 615, as described with reference to FIGS. 4-5. Main fluid channel 615 is an example of, or includes aspects of, the corresponding element described with reference to FIGS. 4, 5, 7, 9-12, and 16.

Projection 605 comprises an o-ring groove 620. For instance, o-ring groove 620 is configured to hold an o-ring. O-ring is an example of, or includes aspects of, the corresponding element described with reference to FIGS. 19, 23-25, and 27. In some cases, o-ring groove 620 in round feature 625 is used to seal water and debris out of a connecting region of a joint.

According to an aspect, connecting region is a region of connection between the projection and a pocket, such as projection 105 described with reference to at least FIG. 1 and pocket 805 described with reference to at least FIG. 8. According to an aspect, connecting region is a region that encompasses a joint connecting two elements together for operation as a single apparatus. In some embodiments, the joint is a threadless joint. In some cases, connecting region refers to an assembled state of the projection and the pocket, forming a joint between an element having a projection and an element having a pocket. Connecting region is an example of, or includes aspects of, the corresponding element described with reference to FIGS. 7, 15, 16, and 19-29.

In one aspect, round feature 625 is used to seal a joint or a connecting region with o-ring or multiple o-rings. According to an embodiment, a shape and a size of round feature 625 is not limited thereto, and round feature 625 may include different shapes and sizes. Round feature 625 is an example of, or includes aspects of, the corresponding element described with reference to FIG. 10.

In one aspect, triangular feature 630 provides rotary strength to the connecting region during a direction drilling operation. In one aspect, triangular feature 630 is configured to transmit torque between the connected elements at the joint. In another aspect, the rotary strength is provided by a generally triangular cross-sectional shape of the triangular feature. According to an embodiment, a shape and a size of triangular feature 630 is not limited thereto, and triangular feature 630 may include different shapes and sizes. Triangular feature 630 is an example of, or includes aspects of, the corresponding element described with reference to FIGS. 4-5.

According to an aspect, small groove 635 may be referred to as a crevice in the connecting region. According to an aspect, small groove 635 may be referred to as an indentation. In one aspect, small groove 635 is configured to assist in a joint separation process. For instance, small groove 635 is used to separate the connecting region (such as the assembled connecting region 1520 described with reference to FIG. 15) into the projection and the pocket.

Figure 7:
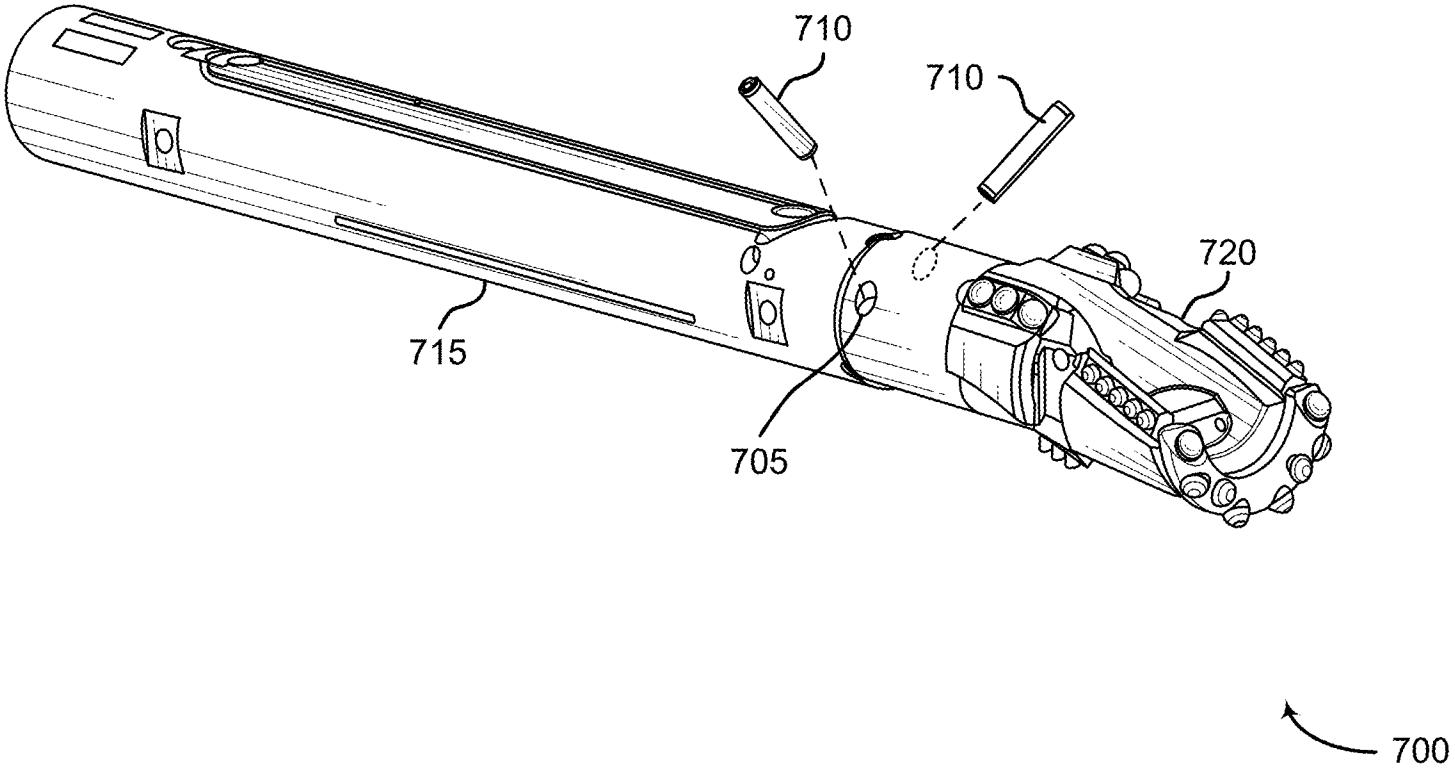
FIG. 7 shows an example of an isometric view of an apparatus for horizontal directional drilling according to aspects of the present disclosure.

FIG. 7 shows an example of an isometric view of an apparatus for horizontal directional drilling 700 according to aspects of the present disclosure. Apparatus for horizontal directional drilling 700 is an example of, or includes aspects of, the corresponding element described with reference to FIGS. 1-6, 8-23, 25, and 27-29.

In one aspect, apparatus 700 includes retention slot 705, pin 710, elongated housing 715, and drilling tool 720. Retention slot 705 is an example of, or includes aspects of, the corresponding element described with reference to FIGS. 4-6, 9-12, and 16.

In one aspect, pin 710 is used to attach the projection and the pocket, such as projection 105 described with reference to at least FIG. 1 and pocket 805 described with reference to at least FIG. 8. In some examples, pin 710 is a coiled pin. In some examples, pin 710 is a slotted pin. In some examples, pin 710 is a split pin. In some examples, pin 710 is a solid pin.

According to an aspect, pin 710 is used to connect the elongated housing 715 and drilling tool 720 via connecting region, such as connecting region described with reference to FIGS. 6, 10, 15, and 30. Pin 710 is an example of, or includes aspects of, the corresponding element described with reference to FIGS. 14, 15, 19, 21, and 23-29. Elongated housing 715 is an example of, or includes aspects of, the corresponding element described with reference to FIGS. 1-3, 19, 20, 23-25, and 27.

As shown in FIG. 7, the drilling tool 720 includes cutting edges made of a wear-resistant material to improve the efficiency of the drilling process. In some aspects, the projection is located on the elongated housing 715, and the pocket is located on the drilling tool 720. Drilling tool 720 is an example of, or includes aspects of, the corresponding element described with reference to FIGS. 16, 19, 20, 22, and 27. Examples of wear resistant materials may include tungsten carbide, high hardness weld beads, and heat treated alloy steel. These wear resistant materials have a hardness between 40 and 88 on the Rockwell C scale.

FIG. 8 shows an example of a front view of a portion of an apparatus for horizontal directional drilling 800 according to aspects of the present disclosure. Portion of apparatus for horizontal directional drilling 800 is an example of, or includes aspects of, the corresponding element described with reference to FIGS. 9-16 and 19-29.

In one aspect, portion of an apparatus for horizontal directional drilling 800 comprises a pulling eye attachment having a female connector.

In one aspect, threadless joint 800 includes pocket 805, and entrance profile 815. In one aspect, pocket 805 refers to a female connecting region. Pocket 805 is an example of, or includes aspects of, the corresponding element described with reference to FIGS. 15, 16, 21, 22, and 26.

According to an embodiment, entrance profile 815 is configured to accept a connecting region, such as a projection (i.e., at least projection 105 described with reference to FIG. 1). In one aspect, entrance profile 815 is similar to, or includes embodiments of, triangular feature described with reference to FIGS. 4-6.

Figure 9:
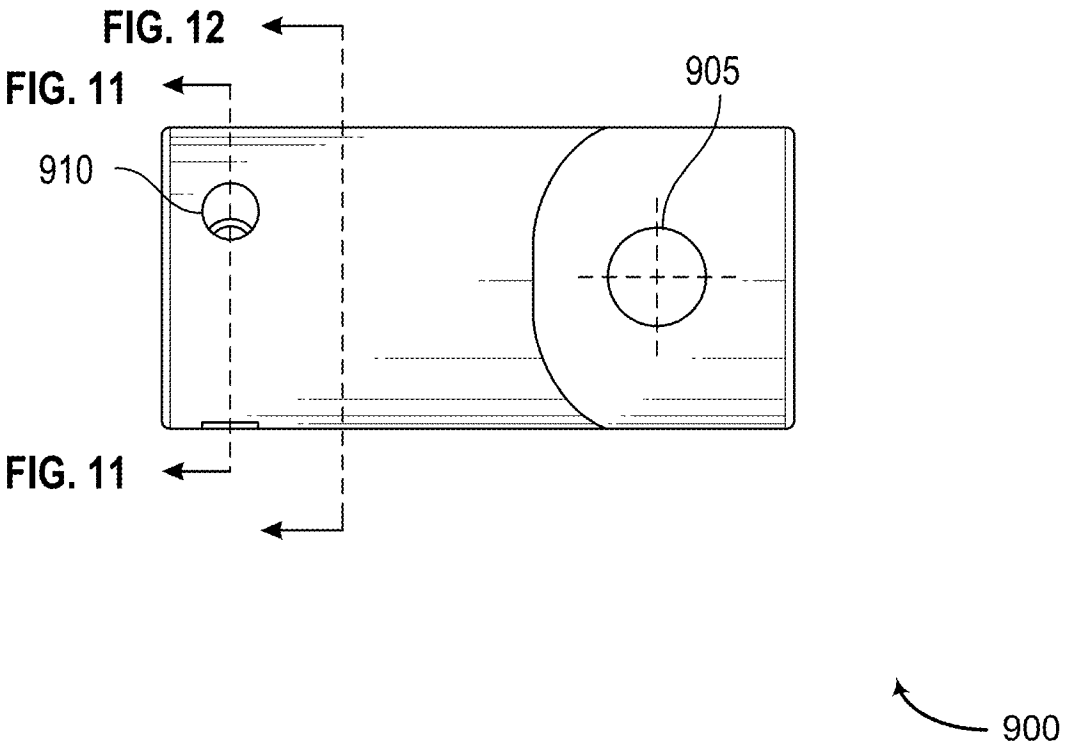
FIGS. 9 through 10 show examples of a side view of the portion of the apparatus according to aspects of the present disclosure.

FIG. 9 shows an example of a side view of a portion of an apparatus for horizontal directional drilling 900 according to aspects of the present disclosure. Portion of apparatus for horizontal directional drilling 900 is an example of, or includes aspects of, the corresponding element described with reference to FIGS. 1-8, 10-23, 25, and 27-29.

In some cases, portion of apparatus for horizontal directional drilling 900 includes pulling eye 905, retention hole 910, and pocket (not shown).

In one aspect, pin hole 910 is a through-hole and in communication with the pocket and configured to hold a pin (such as pin 710 described with reference to FIG. 7). Pin hole 910 is an example of, or includes aspects of, the corresponding element described with reference to FIGS. 4-7, 10-12, and 16.

In one aspect, pulling eye 905 is used for attaching a utility pipe (such as a plastic pipe for installation of utilities such as telecommunication lines, gas distribution lines, etc.) with the drilling tool (such as drilling tool 720 described with reference to FIG. 7). Pulling eye 905 is an example of, or includes aspects of, the corresponding element described with reference to FIGS. 13, 18, 25-26, and 28-29.

Figure 10:
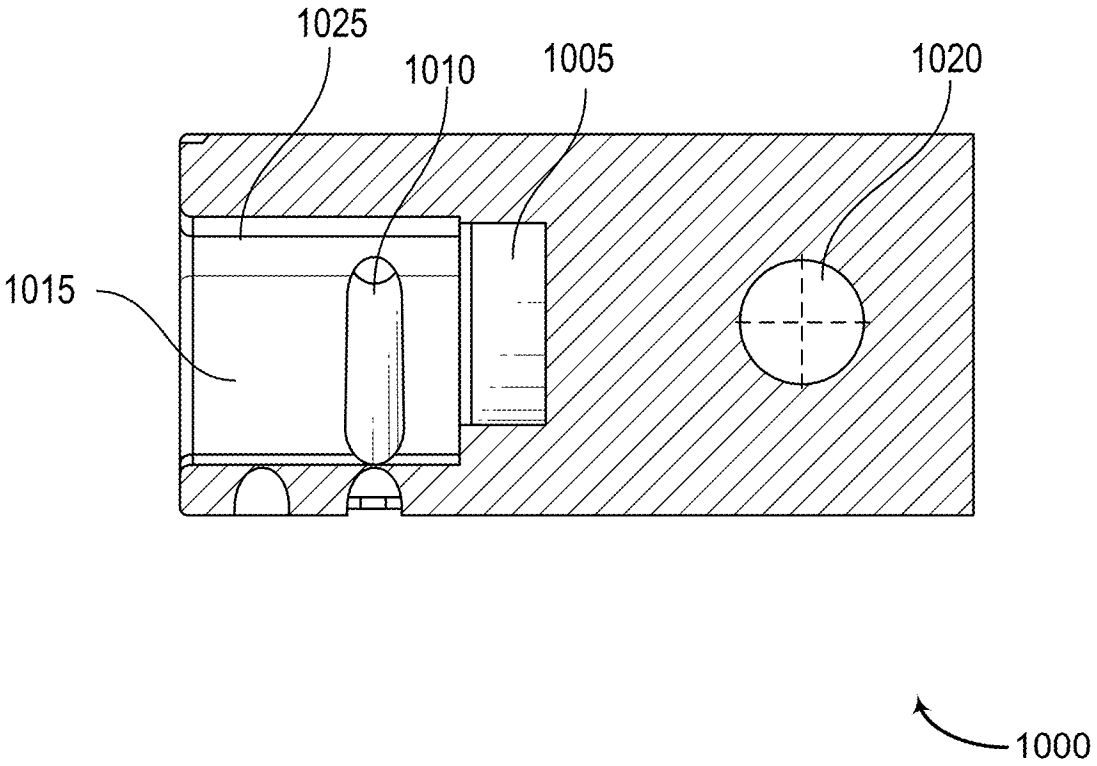

FIG. 10 shows an example of a side view of portion of apparatus for horizontal directional drilling 1000 according to aspects of the present disclosure. Portion of apparatus for horizontal directional drilling 1000 is an example of, or includes aspects of, the corresponding element described with reference to FIGS. 1-9, 11-23, 25, and 27-29. In one aspect, portion of apparatus for horizontal directional drilling 1000 depicts pulling eye 1020. Pulling eye 1020 is an example of, or includes aspects of, the corresponding element described with reference to FIGS. 4-7, 9, 11, 12, and 16.

In one aspect, portion of apparatus 1000 depicts pocket 1015. In some cases, pocket 1015 includes round feature 1005 and pin hole 1010. Pocket 1015 is an example of, or includes aspects of, the corresponding element described with reference to FIGS. 7-9, 11-12, 21-22 and 26.

In one aspect, pin hole 1010 is configured to hold a pin (such as pin 710 described with reference to FIG. 7). Pin hole 1010 is an example of, or includes aspects of, the corresponding element described with reference to FIGS. 9-13, 15, 16, and 19-29.

In one aspect, round feature 1005 is used to seal the connecting region, such as connecting region described with reference to FIGS. 6-7, 15, and 30. In some cases, round feature 1005 uses an o-ring (such as the o-ring described with reference to FIGS. 19, 23-25, and 27) to perform the sealing operation. In some examples, round feature 1005 uses a plurality of o-rings to perform the sealing operation.

According to an embodiment, the shape and a size of round feature 1005 is not limited thereto, and round feature 1005 may include different shapes and sizes. Round feature 1005 is an example of, or includes aspects of, the corresponding element described with reference to FIGS. 2-4.

According to an embodiment, entrance profile 1025 is configured to accept a male connector, such as a projection (i.e., at least projection 105 described with reference to FIG. 1). In one aspect, entrance profile 1025 is similar to, or includes embodiments of, triangular feature described with reference to FIGS. 4-6.

Figure 11:
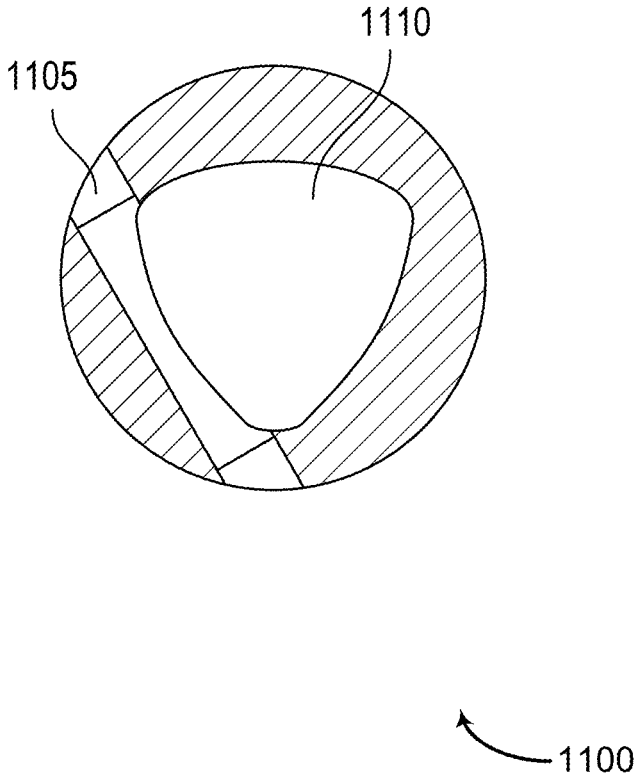
FIGS. 11 through 12 show examples of a front section of the portion of the apparatus according to aspects of the present disclosure.

FIG. 11 shows an example of a front section of a portion of an apparatus for horizontal directional drilling 1100 according to aspects of the present disclosure. For instance, FIG. 11 indicates a front section view through the entrance profile and a first pin hole as illustrated in FIG. 9.

Portion of the apparatus for horizontal directional drilling 1100 is an example of, or includes aspects of, the corresponding element described with reference to FIGS. 1-10, 12-23, 25, and 27-29. In one aspect, threadless joint 1100 includes a pocket 1110, such as a pocket described with reference to FIGS. 7-10, 12, 21-22 and 26.

In some cases, the pocket 1110 comprises pin hole 1105. In one aspect, pin hole 1105 is a through-hole configured to hold a pin (such as pin 710 described with reference to FIG. 7) for attaching the elongated housing (such as elongated housing 715 described with reference to FIG. 7) and the drilling tool (such as drilling tool 720 described with reference to FIG. 7). Pin hole 1105 is an example of, or includes aspects of, the corresponding element described with reference to FIGS. 9-13, 15, 16, and 19-29.

Figure 12:
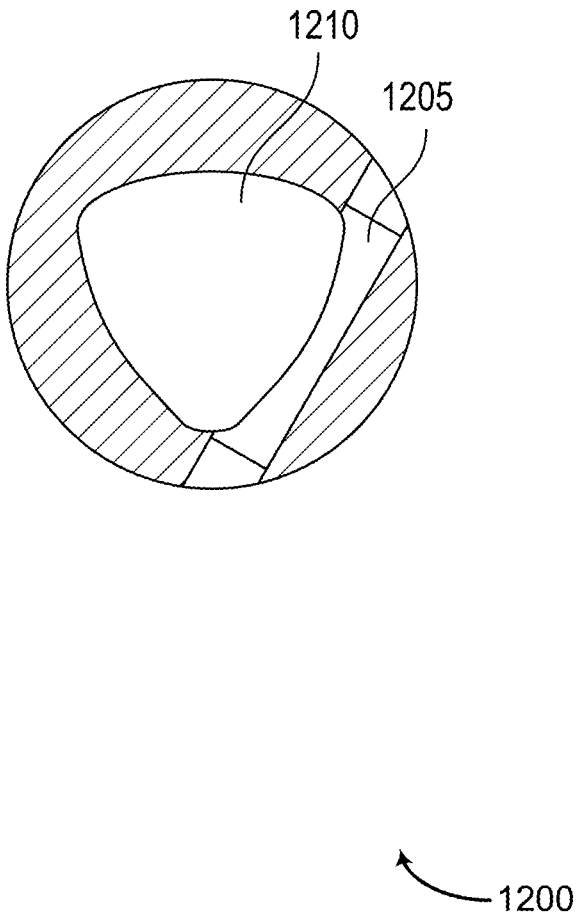

FIG. 12 shows an example of a front section of a portion of an apparatus for horizontal directional drilling 1200 according to aspects of the present disclosure. For instance, FIG. 12 indicates a front section view through the entrance portion and a second pin hole as illustrated in FIG. 9.

Portion of apparatus for horizontal directional drilling 1200 is an example of, or includes aspects of, the corresponding element described with reference to FIGS. 1-11, 13-23, 25, and 27-29.

In one aspect, portion of apparatus for horizontal directional drilling 1200 includes a pocket 1210, such as a pocket described with reference to FIGS. 7-11, 21-22, and 26. In some cases, the pocket comprises retention slot 1205.

In one aspect, pin hole 1205 is a through-hole is configured to hold a pin (such as pin 710 described with reference to FIG. 7) for attaching the elongated housing (such as elongated housing 715 described with reference to FIG. 7) and the drilling tool (such as drilling tool 720 described with reference to FIG. 7). Pin hole 1205 is an example of, or includes aspects of, the corresponding element described with reference to FIGS. 9-13, 15, 16, and 19-29.

Figure 13:
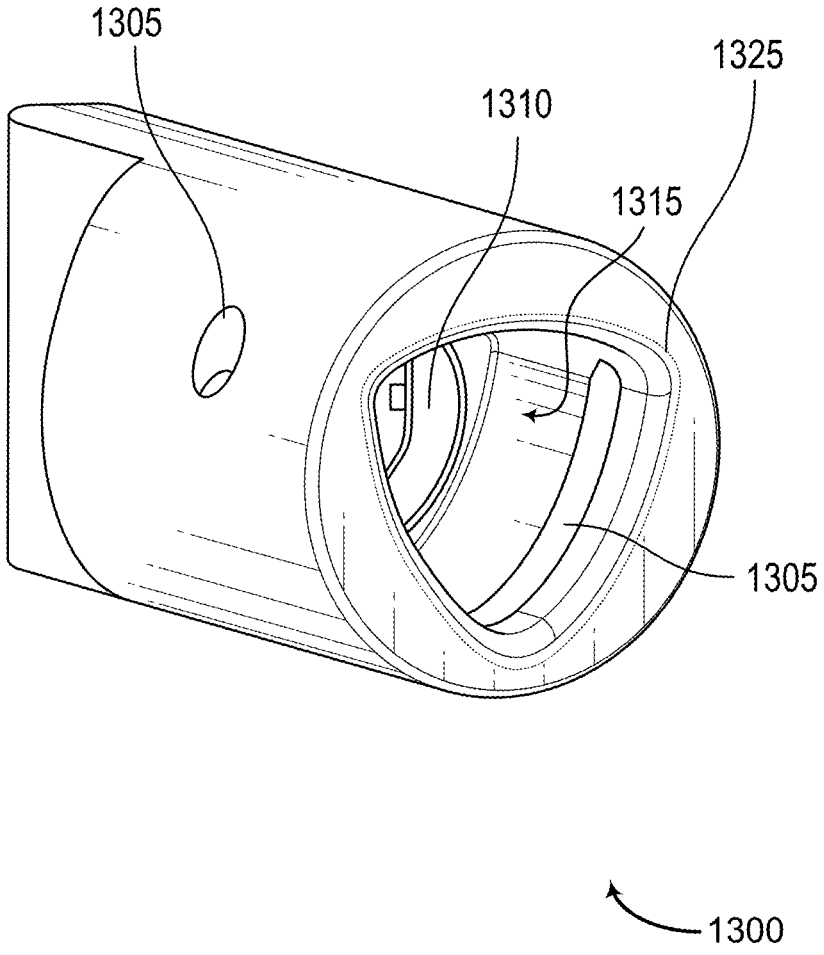
FIG. 13 shows an example of an isometric view of the portion of the apparatus according to aspects of the present disclosure.

FIG. 13 shows an example of an isometric view of a portion of an apparatus for horizontal directional drilling 1300 according to aspects of the present disclosure. Portion of apparatus for horizontal directional drilling 1300 is an example of, or includes aspects of, the corresponding element described with reference to FIGS. 1-12, 14-23, 25, and 27-29.

In one aspect, portion of apparatus for horizontal directional drilling 1300 includes a pocket 1315, such as a pocket described with reference to FIGS. 7-10, 12, 21-22 and 26. In some cases, the portion of apparatus 1300 comprises round feature 1305. In some cases, an interior shape and size of the pocket 1315 is configured to mate with an external shape and size of the projection (such as projection 1705 described in FIG. 17).

In the embodiment shown in FIG. 13, portion of apparatus 1300 includes two pin holes 1305, each configured to receive a pin (such as pin 710 described with reference to FIG. 7) for attaching the elongated housing (such as elongated housing 715 described with reference to FIG. 7) and the drilling tool (such as drilling tool 720 described with reference to FIG. 7). In FIG. 13, only the exterior penetration through the wall bounding the pocket is visible for the left-hand pin hole 1305, and only the slot in the interior surface of the wall is visible for the right-hand pin hole 1305. It will be appreciated, referring again to FIG. 9-13, that each pin hole 1305 comprises two exterior penetrations (holes) continuously connected to an interior slot interposed between the exterior penetrations, thereby forming a through-hole shaping a cavity for receiving a pin.

Pin holes 1305 are an example of, or includes aspects of, the corresponding element described with reference to FIGS. Sep. 9, 2012, 15, 16, and 19-29.

Round feature 1310 is an example of, or includes aspects of, the corresponding element described with reference to FIGS. 10, and 20-22.

Entrance profile 1325 is an example of, or includes aspects of, the corresponding element described with reference to FIGS. 10-12.

FIG. 14 shows an example of an isometric view of connecting region 1400 of a threadless joint according to aspects of the present disclosure. Connecting region 1400 is an example of, or includes aspects of, the corresponding element described with reference to FIGS. 1-13, 15-23, 25, and 27-29. As shown in FIG. 14, Male connector side of connecting region 1400 includes projection 1405, retention slot 1410. Pins 1415 are installed to secure the projection 1405 to the pocket (not shown). Projection 1405 is an example of, or includes aspects of, the corresponding element described with reference to FIGS. 1-3, 6, 15-16, 18, 19, and 23-25. In one aspect, each of FIG. 14A, FIG. 14B, FIG. 14C, and FIG. 14D depict an assembled connection of the projection and the pocket, such as pocket 805 described with reference to FIG. 8. In FIGS. 14A-14D the female connector side of the connecting region containing the pocket and pin holes is shown only in dashed lines for clarity.

Figure 14A:
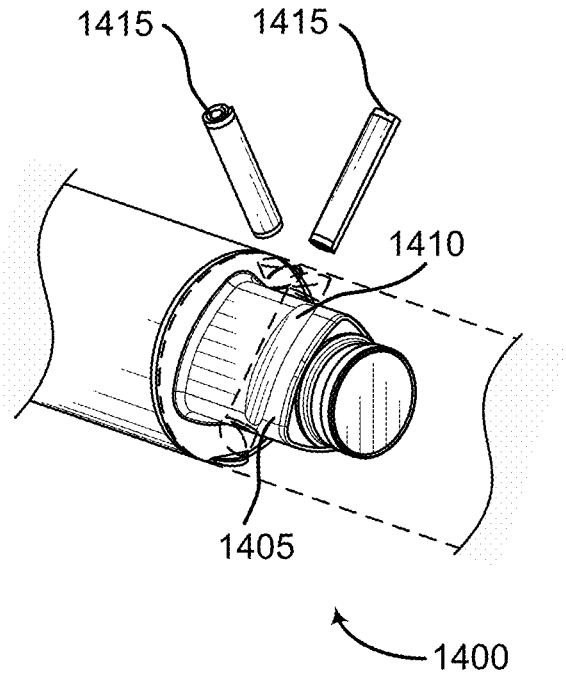
FIG. 14A shows an example of an isometric view of an unassembled two-pin threadless joint connecting region of an apparatus for horizontal directional drilling according to aspects of the present disclosure.
Figure 14B:
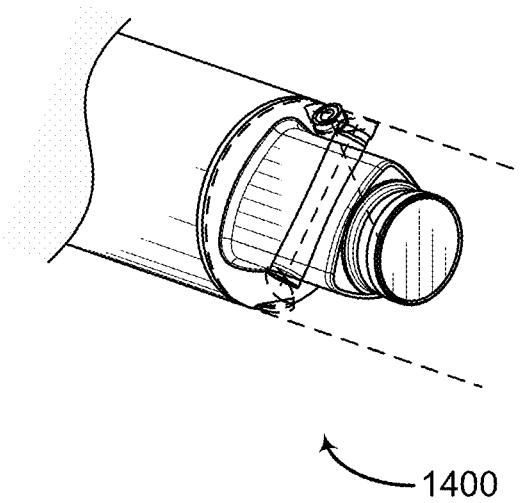
FIG. 14B shows an example of an isometric view of an assembled two-pin threadless joint connecting region of an apparatus for horizontal directional drilling according to aspects of the present disclosure.
Figure 14C:
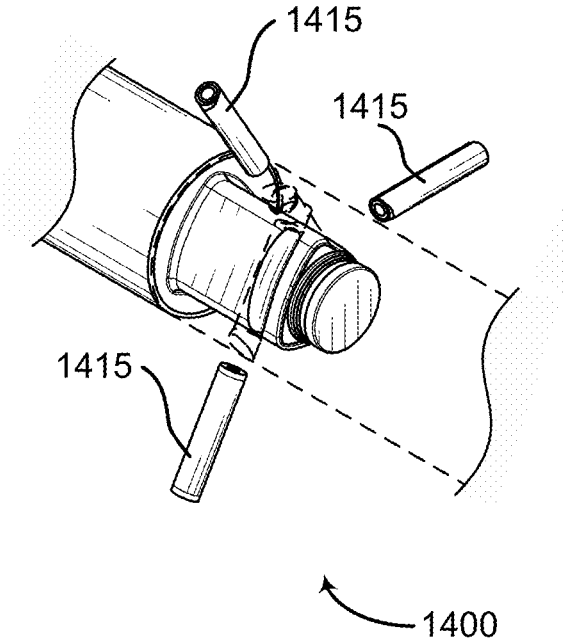
FIG. 14C shows an example of an isometric view of an unassembled three-pin threadless joint connecting region of an apparatus for horizontal directional drilling according to aspects of the present disclosure.
Figure 14D:
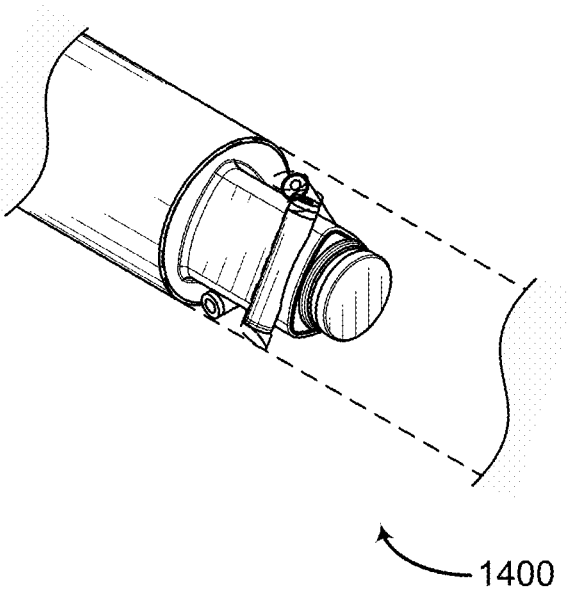
FIG. 14D shows an example of an isometric view of an unassembled three-pin threadless joint connecting region of an apparatus for horizontal directional drilling according to aspects of the present disclosure.

In one aspect, each of FIG. 14A and FIG. 14C depict an orientation of pin 1415 in an uninstalled state. In one aspect, each of FIG. 14B and FIG. 14D depict an orientation of pin 1415 in an installed state, i.e., pin 1415 is installed in the pin hole (indicated by dashed lines) and retention slot 1410. Retention slot 1410 is an example of, or includes aspects of, the corresponding element described with reference to FIGS. 15 and 16. Pin 1415 is an example of, or includes aspects of, the corresponding element described with reference to FIGS. 7, 15, 19, 21, and 23-29.

In one aspect, FIGS. 14A and 14B depict a connecting region utilizing two pins. In one aspect, FIGS. 14C and 14D depict a connecting region utilizing three pins. As shown in FIG. 14, the pins 1415 are spaced in the direction of the longitudinal axis of the apparatus 1400.

FIG. 15 shows an example of a side view of a portion of an apparatus for horizontal directional drilling 1500 including a connection region of a threadless joint according to aspects of the present disclosure. Portion of apparatus 1500 is an example of, or includes aspects of, the corresponding element described with reference to FIGS. 1-14, 16-23, 25, and 27-29.

In one aspect, each of FIG. 15A and FIG. 15C depict an orientation of pins 1510 in an uninstalled state. In one aspect, each of FIG. 15B and FIG. 15D depict an orientation of pins 1510 in an installed state, i.e., each pin 1510 is installed in the corresponding pin hole 1515 and retention slot 1525. The pocket (e.g. the pocket of the female connector of FIGS. 9-13) is shown only in dashed lines in FIGS. 15C and 15D for clarity.

In one aspect, Portion of apparatus 1500 includes connecting region 1520. In some cases, connecting region 1520 indicates an assembled state of the projection 1505 and pocket (such as pocket 805 described with reference to FIG. 8). In some cases, connecting region 1520 includes projection 1505, pins 1510, pin holes 1515, retention slots 1525, and pocket (not shown). Projection 1505 is an example of, or includes aspects of, the corresponding element described with reference to FIGS. 1-3, 6, 14, 16, 18, 19, and 23-25.

In one aspect, each of FIG. 15A, FIG. 15B, FIG. 15C, and FIG. 15D depict an assembled connection of projection and pocket, such as projection described with reference to FIGS. 1-6 and pocket described with reference to FIGS. 8-13.

Pin 1510 is an example of, or includes aspects of, the corresponding element described with reference to FIGS. 7, 14, 19, 21, and 23-29. Pin hole 1515 is an example of, or includes aspects of, the corresponding element described with reference to FIGS. 14 and 16. Retention slot 1525 is an example of, or includes aspects of, the corresponding element described with reference to FIGS. 4-6, and 14-30.

Figure 16A:
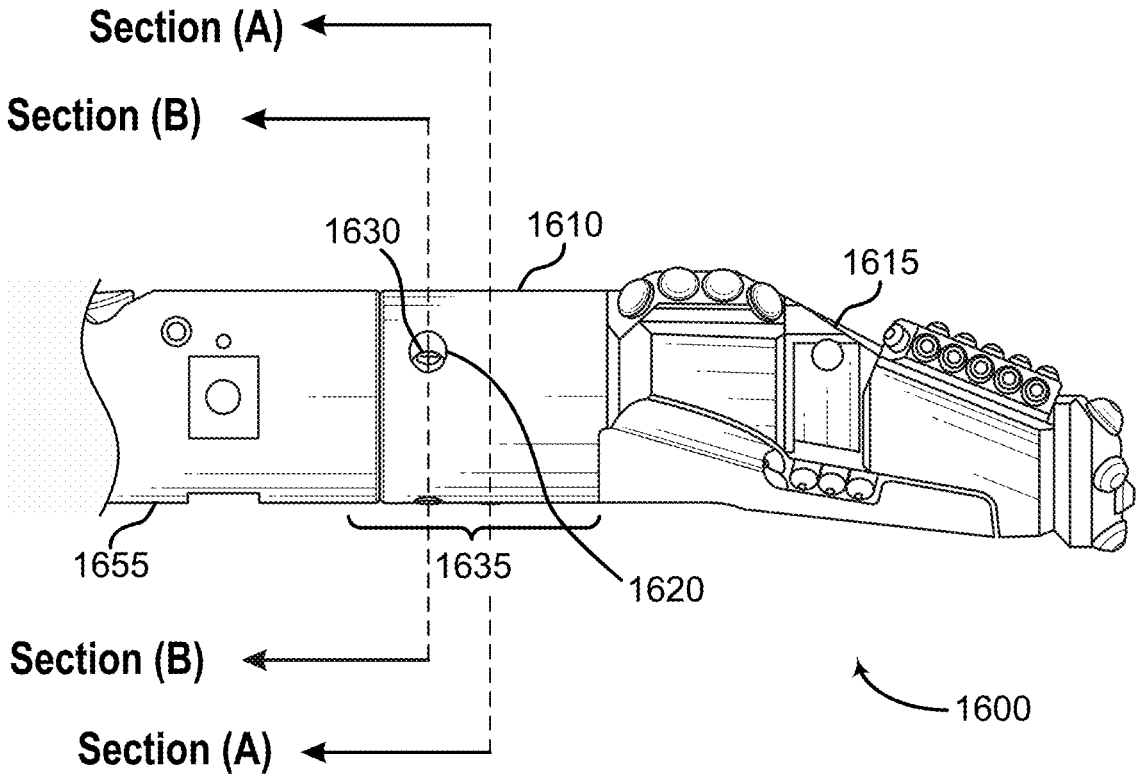
FIG. 16A shows an example of a side view of a portion of an apparatus for horizontal directional drilling including a connecting region according to aspects of the present disclosure.

FIG. 16A shows an example of a side view of a portion of an apparatus for horizontal directional drilling 1600 including a connecting region forming a threadless joint according to aspects of the present disclosure. Connecting region 1600 is an example of, or includes aspects of, the corresponding element described with reference to FIGS. 1-15, 17-23, 25, and 27-29.

In one aspect, connecting region 1600 includes male connector 1650 having projection 1605, female connector 1610 having pocket 1645, drilling tool 1615, pin hole 1620, main fluid channel 1625, pin 1630, connecting region 1635, and retention slot 1640. FIG. 16 depicts an assembled connection of projection 1605 and pocket 1610. Elongated housing 1655 is also shown. In one aspect, FIG. 16 depicts an orientation of pin 1630 in pin hole 1620 in an installed state.

Projection 1605 is an example of, or includes aspects of, the corresponding element described with reference to FIGS. 1-3, 6, 14, 18, 19, and 23-25. Pocket 1610 is an example of, or includes aspects of, the corresponding element described with reference to FIGS. 8, 15, 21, 22, and 26. Drilling tool 1615 is an example of, or includes aspects of, the corresponding element described with reference to FIGS. 7, 19, 20, 22, and 27. Pin hole 1620 is an example of, or includes aspects of, the corresponding element described with reference to FIGS. 14 and 15.

Figure 16B:
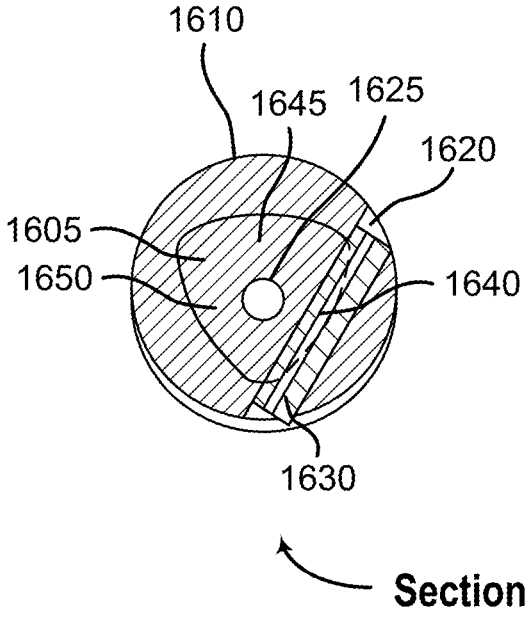
FIG. 16B shows an example of a sectional view of the portion of the apparatus for horizontal directional drilling including a connecting region of FIG. 16A
Figure 16C:
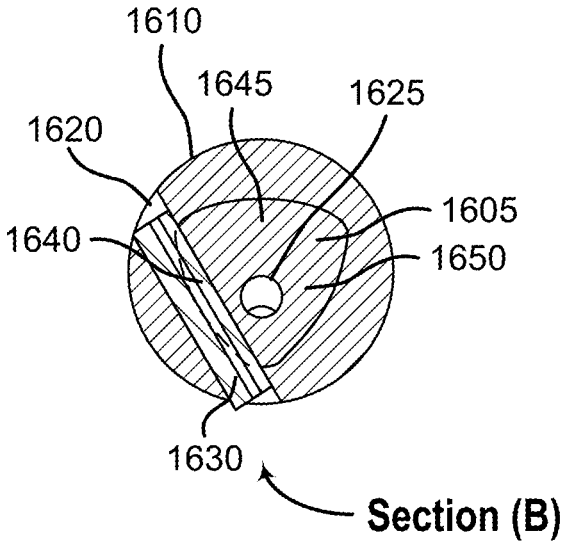
FIG. 16C shows an example of a sectional view of the portion of the apparatus for horizontal directional drilling including a connecting region of FIG. 16A FIGS. 17 and 18 show examples of an isometric view of each of various implementations of a portion of an apparatus for horizontal directional drilling including a male connector of a threadless joint connecting region according to aspects of the present disclosure.

FIG. 16B depicts a cross-sectional view as indicated by the dotted lines in Section (A) in threadless joint 1600. FIG. 16C depicts a cross-sectional view as indicated by the dotted lines in Section (B) in threadless joint 1600. In some cases, each of FIG. 16B and FIG. 16C depict a configuration of retention slot 1625. In some examples, retention slot 1625 is a hole on projection 1605. In some examples, retention slot 1625 is a hole on pocket 1610. Retention slot 1625 is an example of, or includes aspects of, the corresponding element described with reference to FIGS. 4-7, and 9-12.

As shown in FIGS. 16A and 16B, the pins 1630 are positioned to intersect the vertices of the rounded polygon exterior cross-sectional shape of the projection 1605 of male connector 1650, thus optimizing the distribution of torque and reducing wear on the connection.

The assembled threadless joint of connecting region 1635 therefore acts as a locking mechanism, thereby securing the drilling tool 1615 to the elongated housing 1655.

Figure 17:
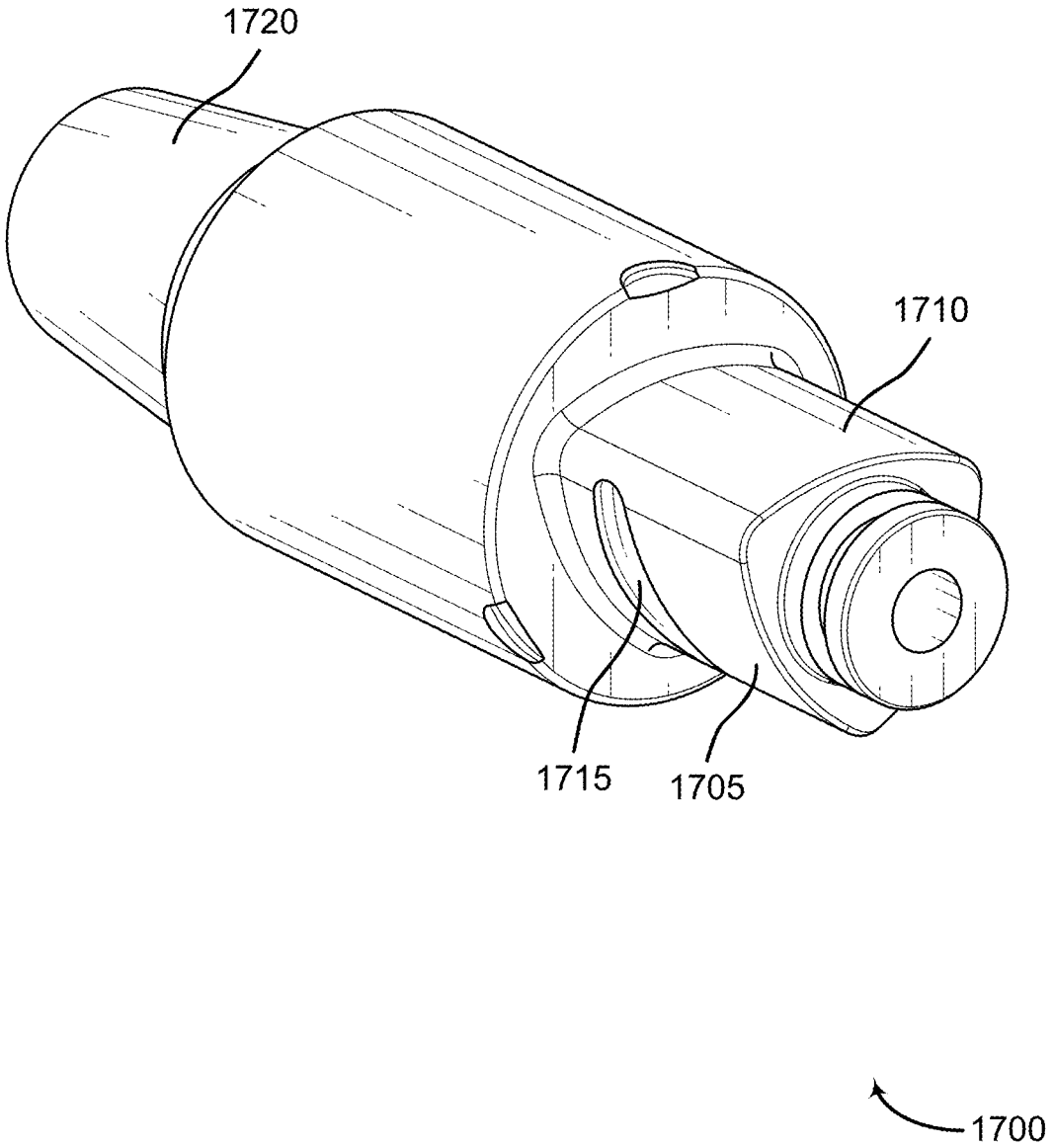

FIG. 17 shows an example of an isometric view of a portion of an apparatus for horizontal directional drilling 1700 including a male connector 1710 of a threadless joint connecting region according to aspects of the present disclosure. In one aspect, projection 1705 includes at least one retention slot 1715. Portion of apparatus for horizontal directional drilling 1700 is an example of, or includes aspects of, the corresponding element described with reference to FIGS. 1-16, 18-23, 25, and 27-29.

In one aspect, male connector 1710 includes projection 1705. As shown in FIG. 17, projection 1705 indicates a configuration of the projection on an end of a male connector 1710. For instance, portion of an apparatus for horizontal directional drilling 1700 may include a threaded projection 1720 on another end, wherein the other end is different from the end with the projection 1705.

Figure 18:
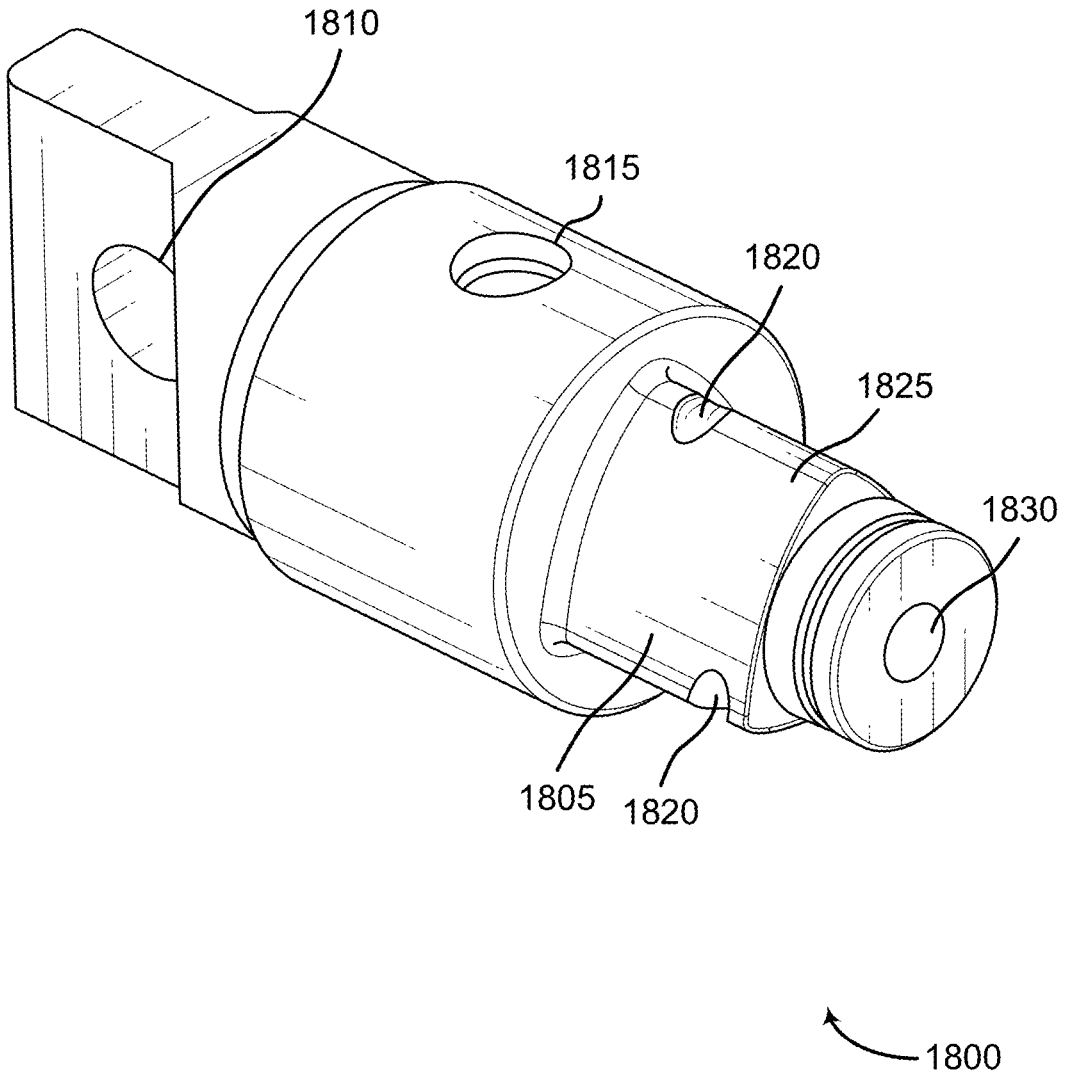

FIG. 18 shows an example of an isometric view of a portion of an apparatus for horizontal directional drilling 1800 including a male connector 1825 of a threadless joint connecting region according to aspects of the present disclosure. Portion of apparatus 1800 is an example of, or includes aspects of, the corresponding element described with reference to FIGS. 1-17, 19-23, 25, and 27-29.

In one aspect, portion of apparatus 1800 includes projection 1805, pulling eye 1810, water port 1815, retention slots 1820, male connector 1825, and main fluid channel 1830. Projection 1805 is an example of, or includes aspects of, the corresponding element described with reference to FIGS. 1-3, 6, 14, 16, 19, and 23-25.

As shown in FIG. 18, portion of apparatus 1800 depicts a male connector 1825 with projection 1805 on one end and a pulling eye 1810 on another end. That is, pulling eye 1810 is located at a different end of portion of an apparatus for horizontal directional drilling 1800 than projection 1805. Pulling eye 1810 is an example of, or includes aspects of, the corresponding element described with reference to FIGS. 25, 26, 28, and 29.

In one aspect, a water port 1815 is provided on the portion of the apparatus for horizontal directional drilling 1800. In some cases, water port 1815 connects the hole on the external surface of the threadless joint 1800 with the main fluid channel 1830, such as main fluid channel described with reference to FIGS. 3, 6, and 8.

Figure 19:
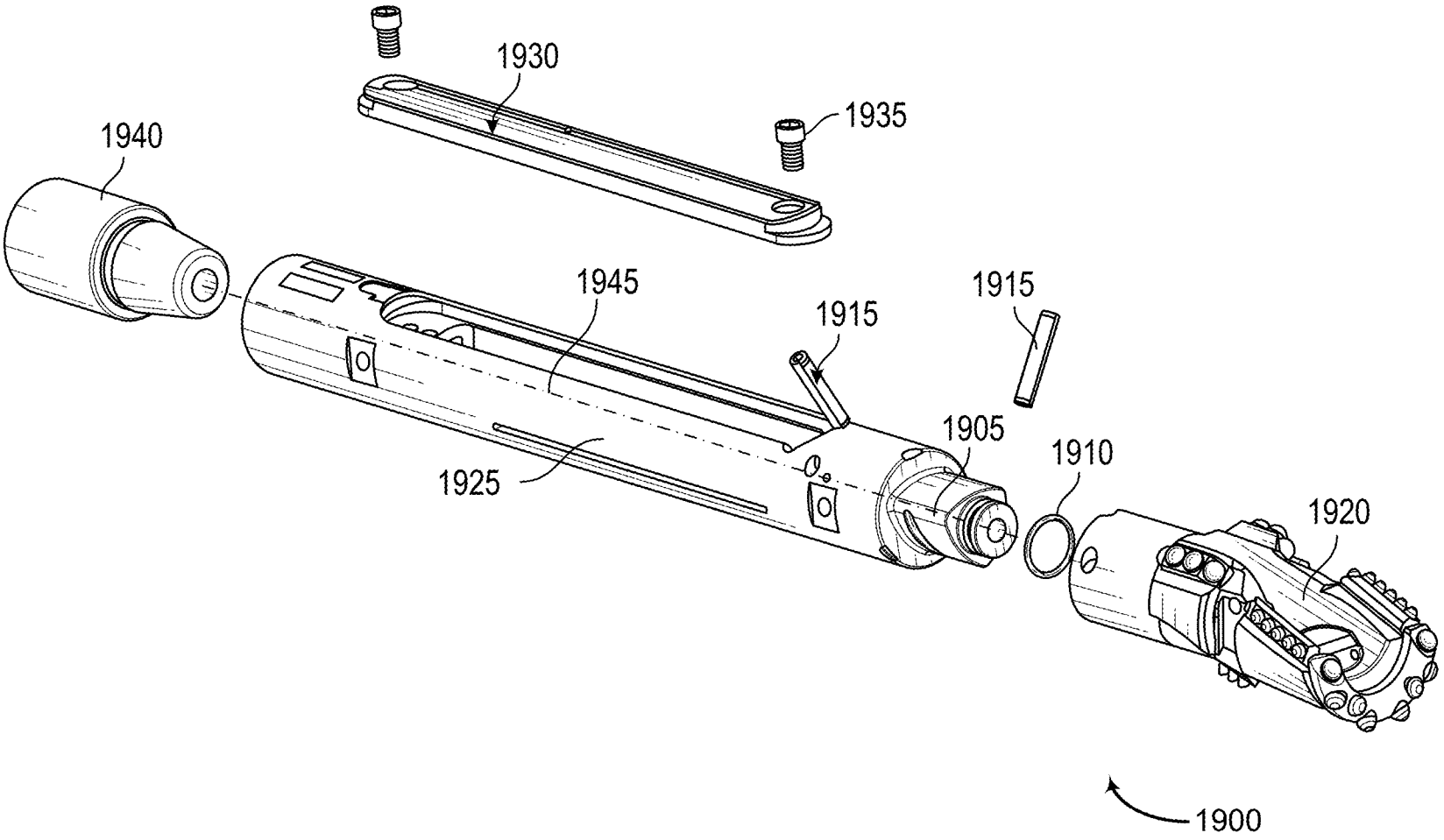
FIG. 19 shows an example of an exploded isometric view of an apparatus for horizontal directional drilling including a threadless joint according to aspects of the present disclosure.

FIG. 19 shows an example of an exploded isometric view of an apparatus for horizontal directional drilling 1900 including a thread adapter according to aspects of the present disclosure. Apparatus for horizontal directional drilling 1900 is an example of, or includes aspects of, the corresponding element described with reference to FIGS. 1-18, 20-23, 25, and 27-29.

In one aspect, apparatus for horizontal directional drilling 1900 includes projection 1905, o-ring 1910, pin 1915, drilling tool 1920, elongated housing 1925, elongated housing lid 1930, elongated housing lid bolt 1935, adapter 1940, and longitudinal axis 1945

As shown in FIG. 19, projection 1905 is used for attaching elongated housing 1925 to drilling tool 1920. In some cases, projection 1905 depicts a shape of a mating rounded polygon. In some cases, the shape of projection 1905 is suited to mate with a pocket, such as pocket 1300 described with reference to FIG. 13. Projection 1905 is an example of, or includes aspects of, the corresponding element described with reference to FIGS. 1-3, 6, 14, 16, 18, and 23-25. Drilling tool 1920 is an example of, or includes aspects of, the corresponding element described with reference to FIGS. 7, 16, 20, 22, and 27.

In some cases, o-ring 1910 is used to seal water and debris out of the threadless joint 1900. Particularly, o-ring 1910 is used to seal a connecting region (such as connecting region 1520 described with reference to FIG. 15) of the threadless joint 1900. O-ring 1910 is an example of, or includes aspects of, the corresponding element described with reference to FIGS. 6, 23-25, and 27.

An embodiment of the present disclosure is configured to implement a locking mechanism to connect the elongated housing and the drilling tool. In some cases, pins 1915 is used to assemble the threadless joint 1900. For instance, pins 1915 are used to secure the connections between elongated housing 1925 and drilling tool 1920. Pin 1915 is an example of, or includes aspects of, the corresponding element described with reference to FIGS. 7, 14, 15, 21, and 23-29.

In some aspects, the locking mechanism includes pins 1915 (e.g., removable pins) designed to intersect a portion of the perimeter of the rounded polygon, thereby securing the drilling tool 1920 to the housing. In some aspects, the removable pins are configured to intersect at least one side of the rounded polygon, ensuring a secure connection between the projection 1905 and the pocket. In some aspects, the locking mechanism includes a pin 1915 (e.g., spring pin) to provide additional resilience and maintain the connection under varying loads. In some aspects, the locking mechanism includes a pin 1915 (e.g., solid pin) to enhance shear strength and withstand high-impact forces during drilling operations. In some aspects, each removable pin is positioned to intersect two vertices of the rounded polygon, optimizing the distribution of torque and reducing wear on the connection.

As shown in FIG. 19, elongated housing 1925 includes an interior region, a front region, a rear region, and a longitudinal axis 1950 extending from the front region to the rear region. In some cases, elongated housing lid 1930 covers elongated housing 1925 using elongated housing lid bolt 1935. Elongated housing 1925 is an example of, or includes aspects of, the corresponding element described with reference to FIGS. 1-3, 7, 20, 23-25, and 27. Elongated housing lid 1930 is an example of, or includes aspects of, the corresponding element described with reference to FIGS. 23-25. Elongated housing lid bolt 1935 is an example of, or includes aspects of, the corresponding element described with reference to FIGS. 23-25. Adapter 1940 (e.g. thread adapter) is an example of, or includes aspects of, the corresponding element described with reference to FIGS. 23-25.

FIG. 20 shows an example of an apparatus for horizontal directional drilling 2000 according to aspects of the present disclosure. Apparatus for horizontal directional drilling 2000 is an example of, or includes aspects of, the corresponding element described with reference to FIGS. 1-19, 21-23, 25, and 27-29.

Figure 20A:
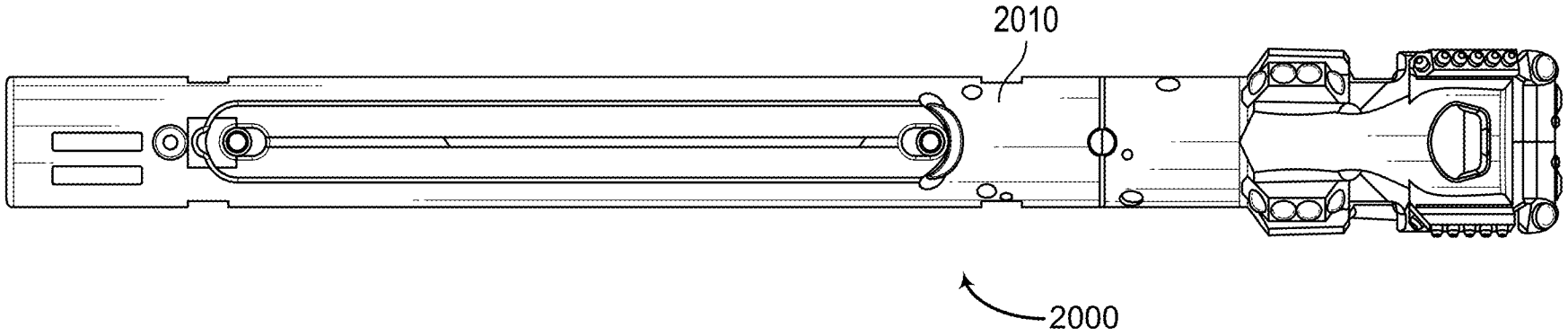
FIG. 20A shows an example of a top view of an apparatus for horizontal directional drilling including a threadless joint according to aspects of the present disclosure.
Figure 20B:
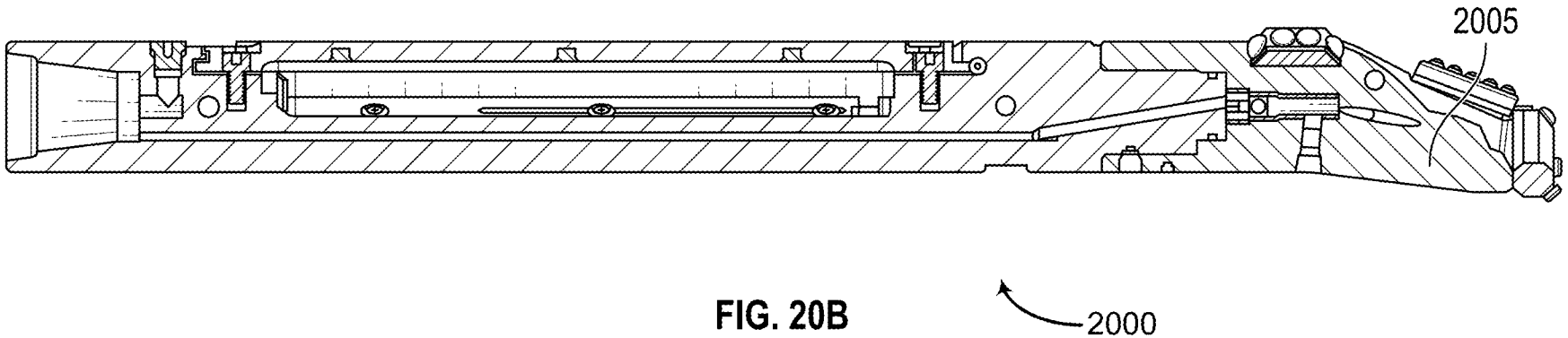
FIG. 20B shows an example of a sectional view of an apparatus for horizontal directional drilling including a threadless joint according to aspects of the present disclosure.

For instance, in some aspects, FIG. 20A depicts a top view of an apparatus for horizontal directional drilling 2000, and FIG. 20B depicts a side view of a apparatus for horizontal directional drilling 2000.

In one aspect, apparatus for horizontal directional drilling 2000 includes drilling tool 2005 and elongated housing 2010 connected by a threadless joint. For instance, FIG. 20A and FIG. 20B depict an assembled state of the elongated housing 2010 and drilling tool 2005. Drilling tool 2005 is an example of, or includes aspects of, the corresponding element described with reference to FIGS. 7, 16, 19, 22, and 27. Elongated housing 2010 is an example of, or includes aspects of, the corresponding element described with reference to FIGS. 1-3, 7, 19, 23-25, and 27.

FIG. 21 shows an example of an isometric view of a portion of an apparatus for horizontal directional drilling 2100. Portion of apparatus 2100 includes a male connector 2105 for a threadless joint at one end of elongated housing 2115 and a female connector 2110 for a threadless joint at an opposite end of elongated housing 2115 according to aspects of the present disclosure. Portion of apparatus 2100 is an example of, or includes aspects of, the corresponding element described with reference to FIGS. 1-20, and 23-29

Figure 21A:
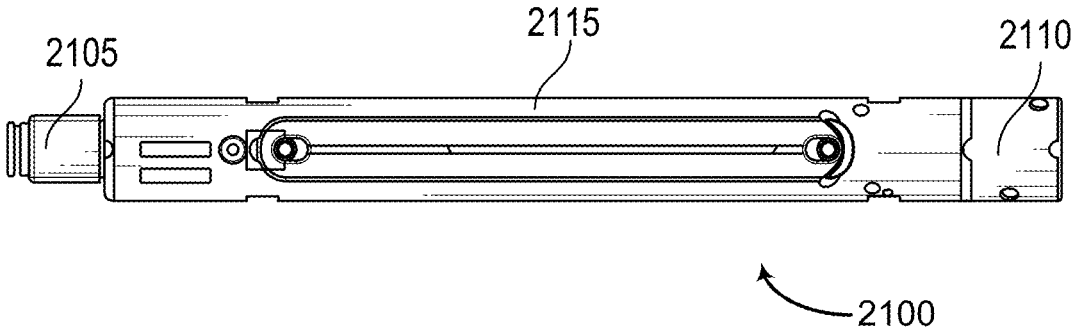
FIG. 21A shows an example of a front view of a portion of an apparatus for horizontal directional drilling including a male connector for a threadless joint and a female connector for a threadless joint according to aspects of the present disclosure.
Figure 21B:
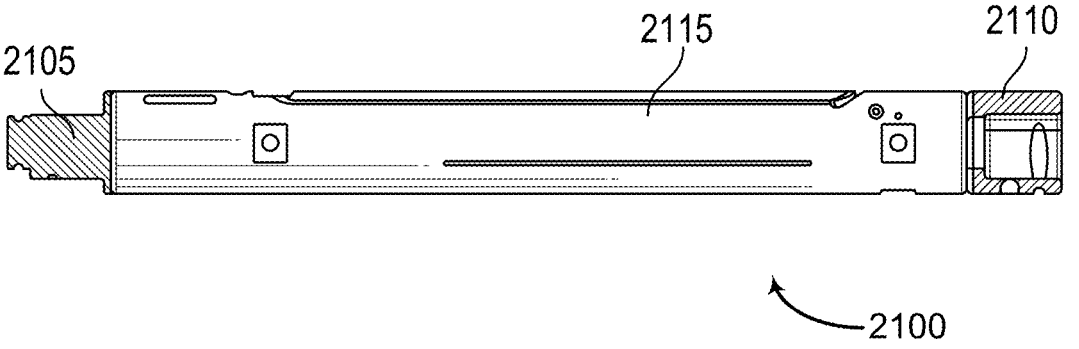
FIG. 21B shows an example of a side view of a portion of an apparatus for horizontal directional drilling including a male connector for a threadless joint and a female connector for a threadless joint according to aspects of the present disclosure.
Figure 21C:
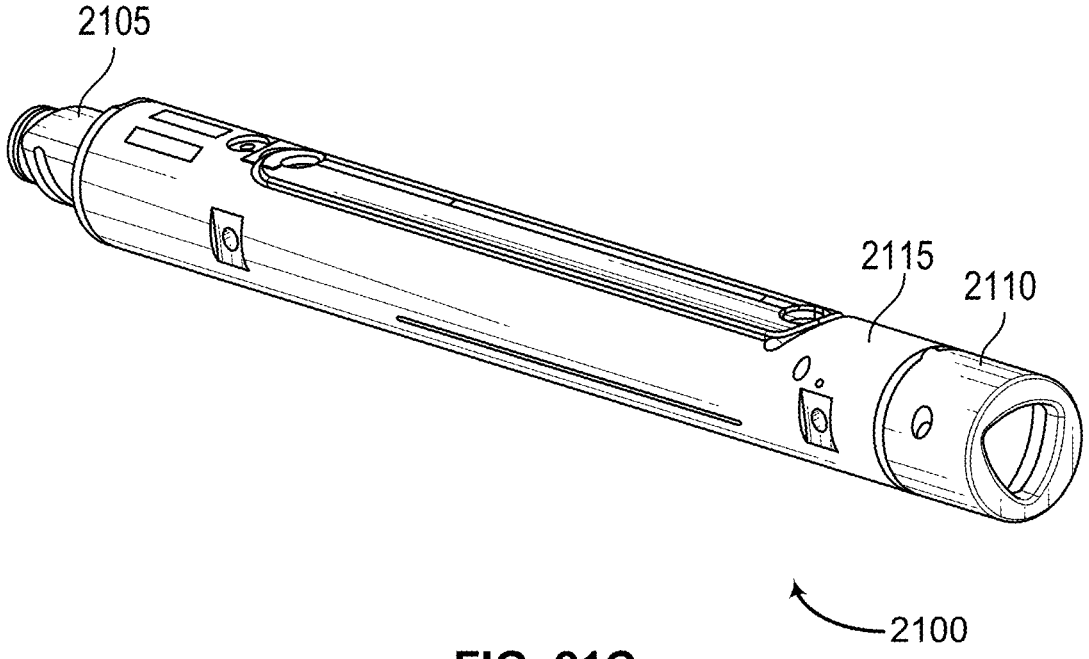
FIG. 21C shows an example of an isometric view of a portion of an apparatus for horizontal directional drilling including a male connector for a threadless joint and a female connector for a threadless joint according to aspects of the present disclosure.

For instance, FIGS. 21A-21C depicts a top view of a portion of apparatus for horizontal directional drilling 2100. Additionally, for instance, FIG. 21B depicts a side view of a portion of apparatus for horizontal directional drilling 2100. For instance, FIG. 21C depicts an isometric view of a portion of an apparatus for horizontal directional drilling 2100.

In one aspect, portion of apparatus 2100 includes male connector 2105, female connector 2110, and elongated housing 2115. Male connector 2105 is an example of, or includes aspects of, the corresponding element described with reference to FIGS. 1-6, 14-20, and 22-39. Female connector 2110 is an example of, or includes aspects of, the corresponding element described with reference to FIGS. 3, 8-13, 14-16, 20, and 22-29.

FIG. 22 shows an example of a portion of an apparatus for horizontal directional drilling 2200 including a female connector according to aspects of the present disclosure. Portion of apparatus for horizontal directional drilling 2200 is an example of, or includes aspects of, the corresponding element described with reference to FIGS. 1-21, 23, 25, and 27-29.

Figure 22A:
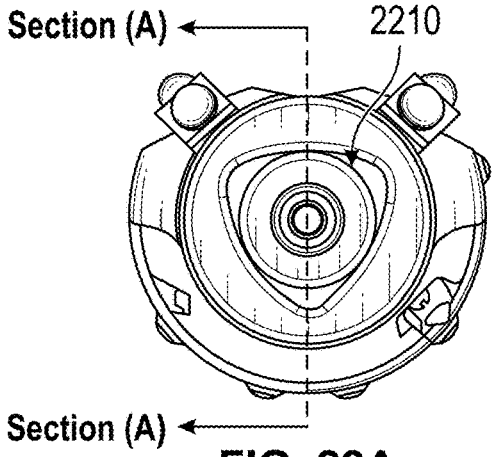
FIG. 22A shows a front end view.
Figure 22B:
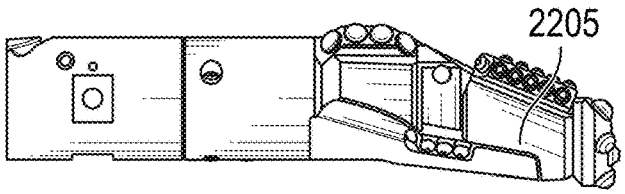
FIG. 22B shows a side view.
Figure 22C:
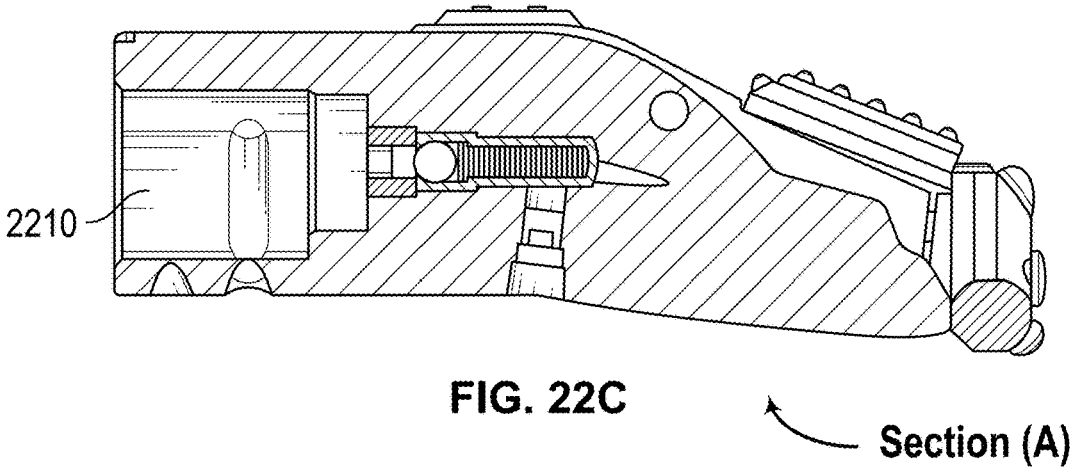
FIG. 22C shows a sectional view.
Figure 22D:
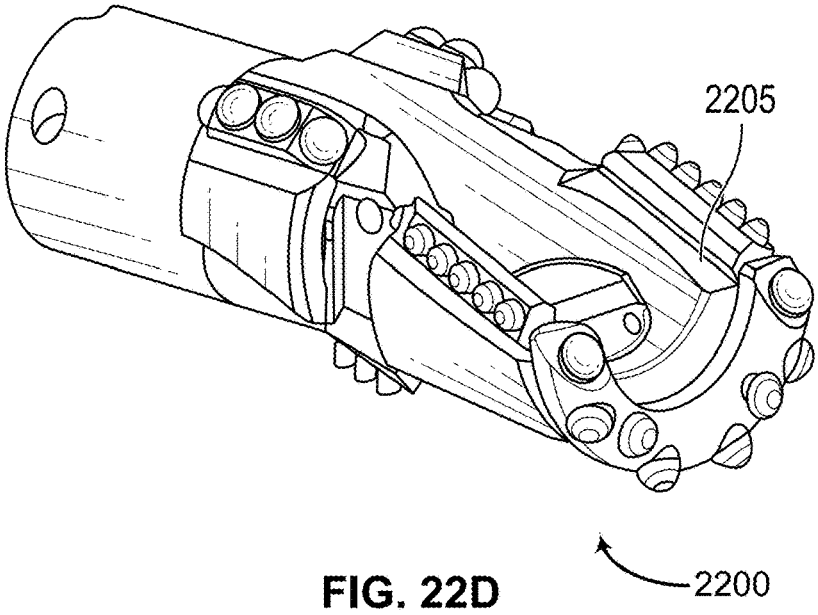
FIG. 22D shows a perspective view.

In one aspect, portion of apparatus for horizontal directional drilling 2200 includes drilling tool 2205. In one aspect, portion of apparatus for horizontal directional drilling 2200 includes female connector having pocket 2210. For instance, FIG. 22C depicts a sectional view of a pocket 2210 of a female connector integrated into drilling tool 2205. Drilling tool 2205 is an example of, or includes aspects of, the corresponding element described with reference to FIGS. 7, 16, 19, 20, and 27. Pocket 2210 is an example of, or includes aspects of, the corresponding element described with reference to FIGS. 8, 15, 16, 21, and 26.

Figure 23:
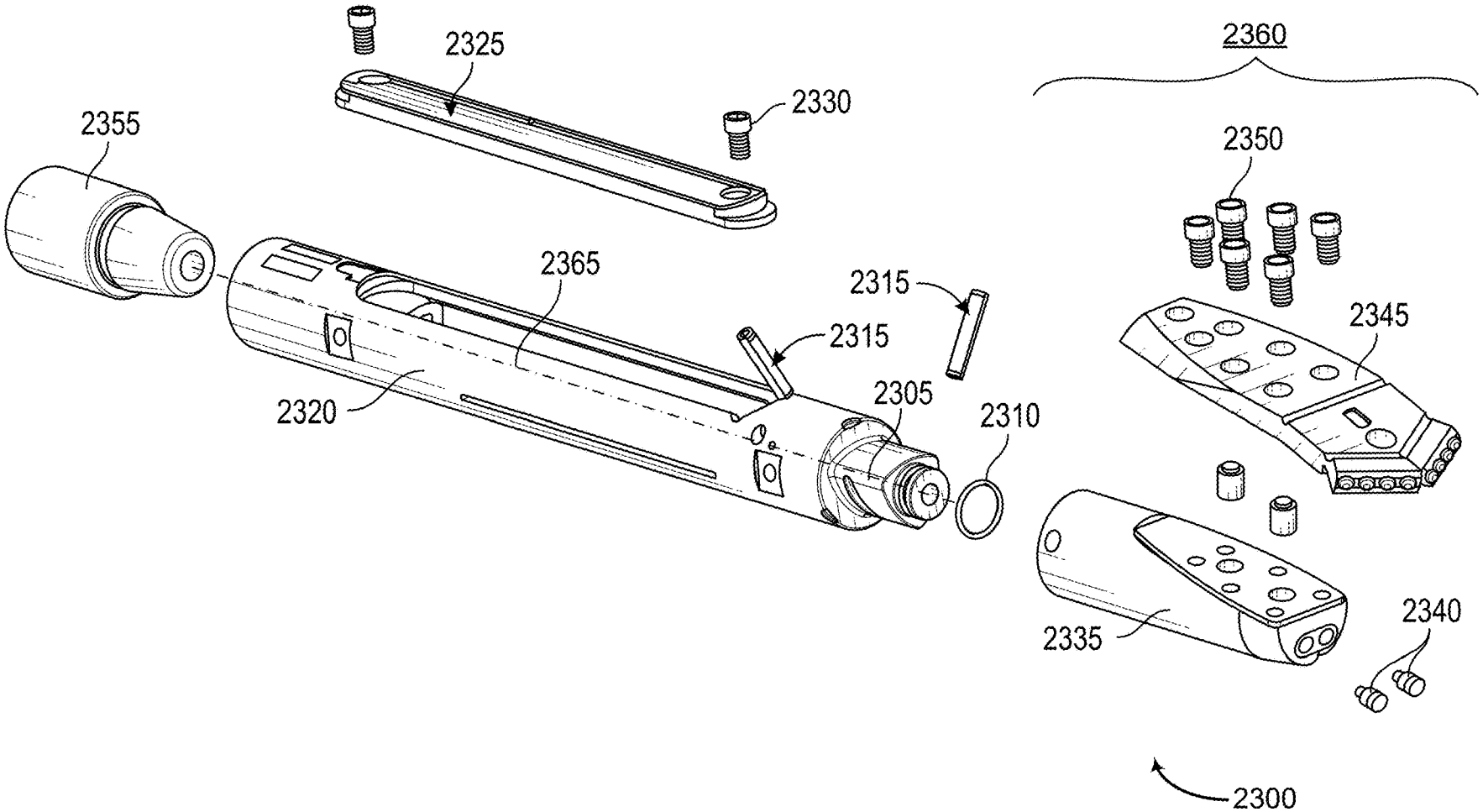
FIGS. 23 through 25 show examples of an exploded isometric view of each of various implementations of an apparatus for horizontal directional drilling including a threadless joint according to aspects of the present disclosure.

FIG. 23 shows an example of an exploded isometric view of an apparatus for horizontal directional drilling 2300 including a threadless joint according to aspects of the present disclosure. Apparatus for horizontal directional drilling 2300 is an example of, or includes aspects of, the corresponding element described with reference to FIGS. 1-22, 25, and 27-29.

In one aspect, apparatus for horizontal directional drilling 2300 includes projection 2305, o-ring 2310, pin 2315, elongated housing 2320, elongated housing lid 2325, elongated housing lid bolt 2330, drilling tool 2360, water nozzle 2340, and adapter 2355. In one aspect, drilling tool 2360 comprises drill bit body 2335, drill bit blade 2345, and drill bit blade fastener 2350. For instance, FIG. 23 depicts a disassembled state of drilling tool 2360.

As shown in FIG. 23, projection 2305 is used for attaching drilling tool 2360 and elongated housing 2320. In some cases projection 2305 comprises at least a portion shaped like a mating rounded polygon. For instance, the mating rounded polygon of projection 2305 is configured to transmit torque between the elongated housing 2320 and drilling tool 2360. In some examples, rounded polygon of projection 2405 is configured to mate with an internal surface of drilling tool 2360 (such as pocket 1300 described in FIG. 13). Projection 2305 is an example of, or includes aspects of, the corresponding element described with reference to FIGS. 1-3, 6, 14, 16, 18, 19, 24, and 25.

In one aspect, o-ring 2310 is used to seal water and debris out of the threadless joint between the elongated housing 2320 and drilling tool 2360. For instance, o-ring 2310 is placed in o-ring groove (such as o-ring groove 620 described with reference to FIG. 6). O-ring 2310 is an example of, or includes aspects of, the corresponding element described with reference to FIGS. 6, 19, 24, 25, and 27.

An embodiment of the present disclosure is configured to implement a locking mechanism to connect the elongated housing and the drilling tool. In some cases, pin 2315 is used to assemble the threadless joint of apparatus 2300. For instance, pin 2315 is used to secure the connections between elongated housing 2320 and drilling tool 2360. Pin 2315 is an example of, or includes aspects of, the corresponding element described with reference to FIGS. 7, 14, 15, 19, 21, and 24-29.

In some cases, elongated housing 2320 includes an interior region, a front region, a rear region, and a longitudinal axis 2365 extending from the front region to the rear region. In some cases, elongated housing lid 2325 covers elongated housing 2320 using elongated housing lid bolt 2330. In some aspects, a sonde transmitter is seated in the interior region. Elongated housing 2320 is an example of, or includes aspects of, the corresponding element described with reference to FIGS. 1-3, 7, 19, 20, 24, 25, and 27. Elongated housing lid 2325 is an example of, or includes aspects of, the corresponding element described with reference to FIGS. 19, 24, and 25. Elongated housing lid bolt 2330 is an example of, or includes aspects of, the corresponding element described with reference to FIGS. 19, 24, and 25. Adapter 2355 is an example of, or includes aspects of, the corresponding element described with reference to FIGS. 19, 24, and 25.

Figure 24:
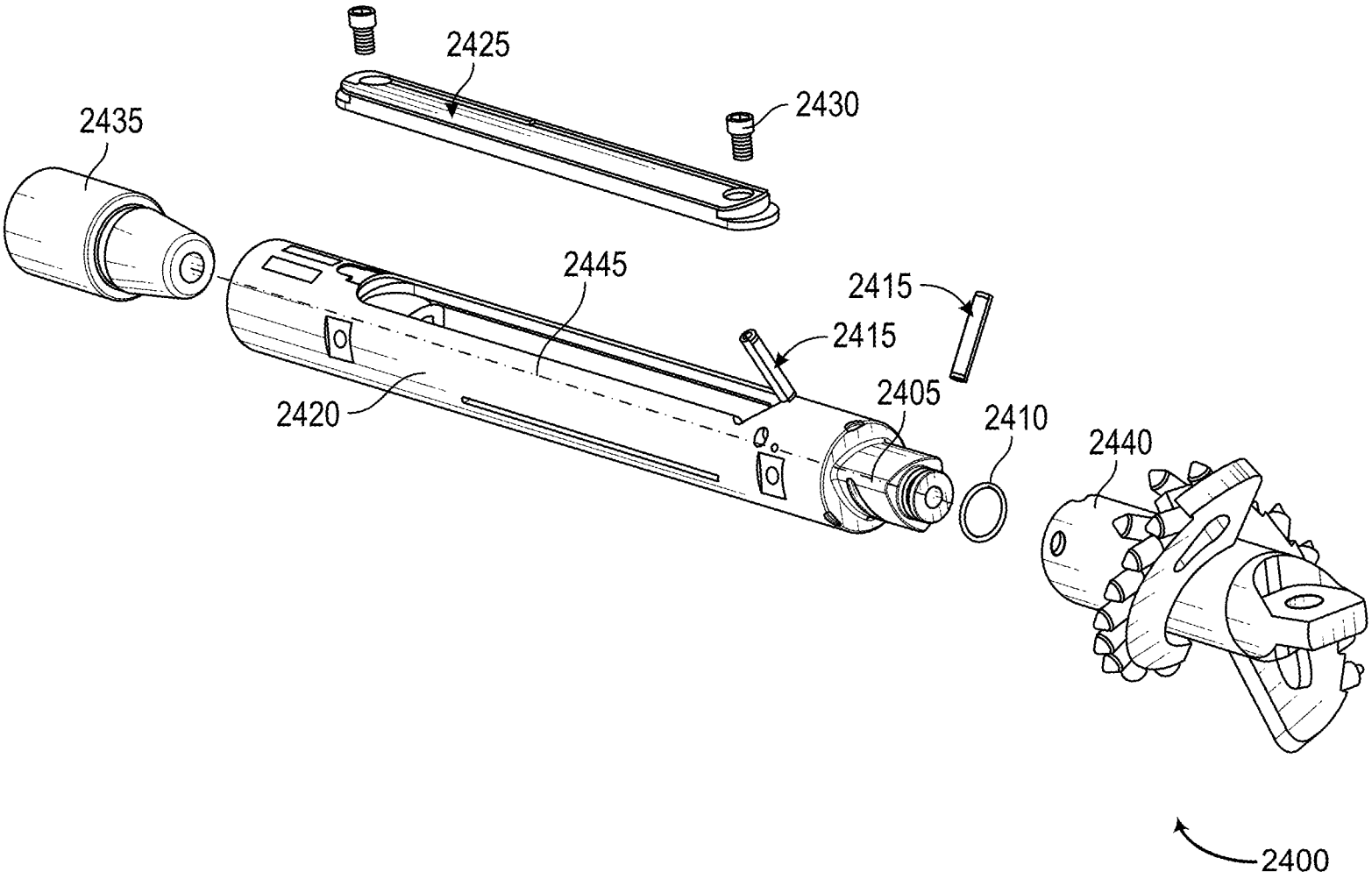

FIG. 24 shows an example of an exploded isometric view of an apparatus for horizontal directional drilling 2400 including a threadless joint according to aspects of the present disclosure. Apparatus for horizontal directional drilling 2400 is an example of, or includes aspects of, the corresponding element described with reference to FIGS. 1-21, 23, 25, and 27-29.

In one aspect, apparatus for horizontal directional drilling 2400 includes projection 2405, o-ring 2410, pin 2415, elongated housing 2420, elongated housing lid 2425, elongated housing lid bolt 2430, adapter 2435, and pull back reamer 2440.

According to an embodiment, at a termination step of the drilling operation, drilling tool (such as drilling tool 1920 described with reference to FIG. 19) is removed and pull back reamer 2440 is attached. In some cases, pull back reamer 2440 may enlarge a hole (such as a bore hole created by the drilling tool) to a size adequate for a product pipe or conduit being installed. Additionally, the drilling fluid may be pumped through the pull back reamer 2440 to aid in the cutting of the soil.

As shown in FIG. 24, projection 2405 is used for attaching pullback reamer 2440 and elongated housing 2420. In some cases, projection 2405 comprises at least a portion shaped like a mating rounded polygon. For instance, the mating rounded polygon of projection 2405 is configured to transmit torque between the elongated housing 2320 and pull back reamer 2440. In some examples, rounded polygon of projection 2405 is configured to mate with an internal surface of pull back reamer 2440 (such as pocket 1300 described in FIG. 13). Projection 2405 is an example of, or includes aspects of, the corresponding element described with reference to FIGS. 1-3, 6, 14, 16, 18, 19, 23, and 25.

In one aspect, o-ring 2410 is used to seal water and debris out of the threadless joint of apparatus 2300. O-ring 2410 is an example of, or includes aspects of, the corresponding element described with reference to FIGS. 6, 19, 23, 25, and 27.

An embodiment of the present disclosure is configured to implement a locking mechanism to connect the elongated housing and the pullback reamer. In some cases, pin 2415 is used to assemble the threadless joint 2400. For instance, pin 2415 is used to secure the connections between elongated housing 2420 and pull back reamer 2440. Pin 2415 is an example of, or includes aspects of, the corresponding element described with reference to FIGS. 7, 14, 15, 19, 21, 23, and 25-29.

In some cases, the drilling fluid may be pumped to condition the bore hole. Additionally, in some cases, the drilling fluid may be pumped to provide a medium for carrying the cuttings out of the bore hole. The drilling fluid may be pumped at a lower pressure and higher flow rate during an operation of pull back reamer 2440 than during the pilot bore drilling operation. Subsequently, the product pipe may be pulled into the enlarged hole (i.e., reamed hole). For instance, the product pipe may be pulled behind the pull back reamer 2440 during the back-ream and pullback operation.

In some cases, elongated housing 2420 includes an interior region, a front region, a rear region, and a longitudinal axis 2445 extending from the front region to the rear region. In some cases, elongated housing lid 2425 covers elongated housing 2420 using elongated housing lid bolt 2430. Elongated housing 2420 is an example of, or includes aspects of, the corresponding element described with reference to FIGS. 1-3, 7, 19, 20, 23, 25, and 27. Elongated housing lid 2425 is an example of, or includes aspects of, the corresponding element described with reference to FIGS. 19, 23, and 25. Elongated housing lid bolt 2430 is an example of, or includes aspects of, the corresponding element described with reference to FIGS. 19, 23, and 25. Adapter 2435 is an example of, or includes aspects of, the corresponding element described with reference to FIGS. 19, 23, and 25.

Figure 25:
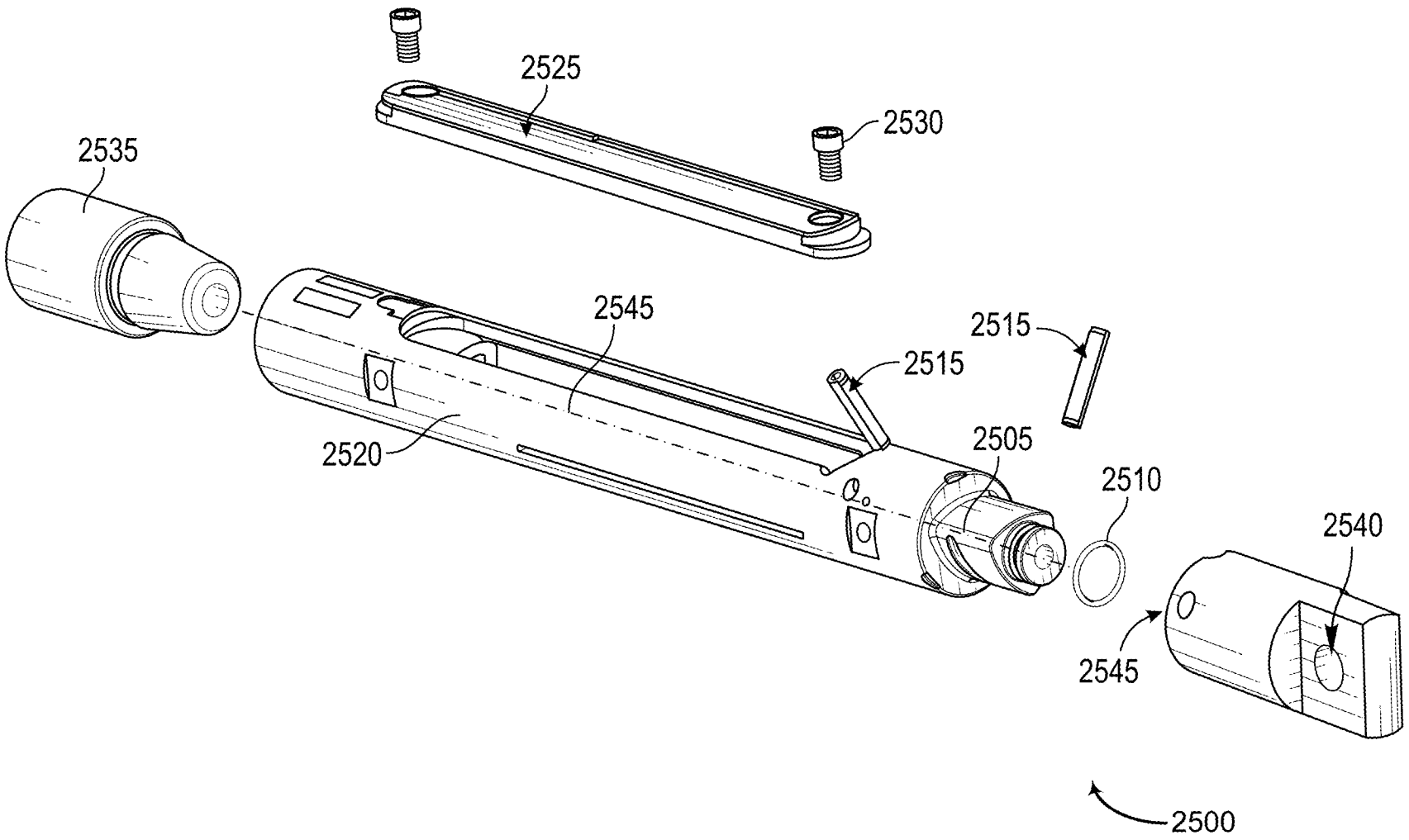

FIG. 25 shows an example of an exploded isometric view of an apparatus for horizontal directional drilling 2500 including a threadless joint according to aspects of the present disclosure. Apparatus for horizontal directional drilling 2500 is an example of, or includes aspects of, the corresponding element described with reference to FIGS. 1-23 and 27-29.

In one aspect, apparatus 2500 includes projection 2505, o-ring 2510, pin 2515, elongated housing 2520, elongated housing lid 2525, elongated housing lid bolt 2530, adapter 2535, and pocket 2545. In one aspect, pocket 2545 includes pulling eye 2540.

As shown in FIG. 25, projection 2505 is used for attaching pulling eye 2540 and elongated housing 2420. In some cases, projection 2505 comprises at least a portion shaped like a mating rounded polygon. For instance, the mating rounded polygon of projection 2505 is configured to transmit torque between the elongated housing 2320 and pulling eye 2540. In some examples, rounded polygon of projection 2505 is configured to mate with an internal surface of a pocket 2545 (now shown; such as pocket 1300 described in FIG. 13). Projection 2505 is an example of, or includes aspects of, the corresponding element described with reference to FIGS. 1-3, 6, 14, 16, 18, 19, 23, and 24.

In one aspect, o-ring 2510 is used to seal water and debris out of the threadless joint of apparatus 2500. O-ring 2510 is an example of, or includes aspects of, the corresponding element described with reference to FIGS. 6, 19, 23, 24, and 27.

An embodiment of the present disclosure is configured to implement a locking mechanism to connect the elongated housing and the pulling eye. In some cases, pin 2515 is used to assemble the threadless joint 2500. For instance, pin 2515 is used to secure the connections between elongated housing 2520 and pulling eye 2540. Pin 2515 is an example of, or includes aspects of, the corresponding element described with reference to FIGS. 7, 14, 15, 19, 21, 23, 24, and 26-29.

In some cases, pulling eye 2540 is used for performing a pull back of a product pipe. For example, pulling eye 2540 is used to attach the product pipe with the drilling tool (such as drilling tool described with reference to FIGS. 7, 16, 19-10, and 22-23) to perform the pulling operation. Pulling eye 2540 is an example of, or includes aspects of, the corresponding element described with reference to FIGS. 18, 26, 28, and 29.

In some cases, elongated housing 2520 includes an interior region, a front region, a rear region, and a longitudinal axis 2545 extending from the front region to the rear region. In some cases, elongated housing lid 2525 covers elongated housing 2520 using elongated housing lid bolt 2530. Elongated housing 2520 is an example of, or includes aspects of, the corresponding element described with reference to FIGS. 1-3, 7, 19, 20, 23, 24, and 27. Elongated housing lid 2525 is an example of, or includes aspects of, the corresponding element described with reference to FIGS. 19, 23, and 24. Elongated housing lid bolt 2530 is an example of, or includes aspects of, the corresponding element described with reference to FIGS. 19, 23, and 24. Adapter 2535 is an example of, or includes aspects of, the corresponding element described with reference to FIGS. 19, 23, and 24.

Figure 26:
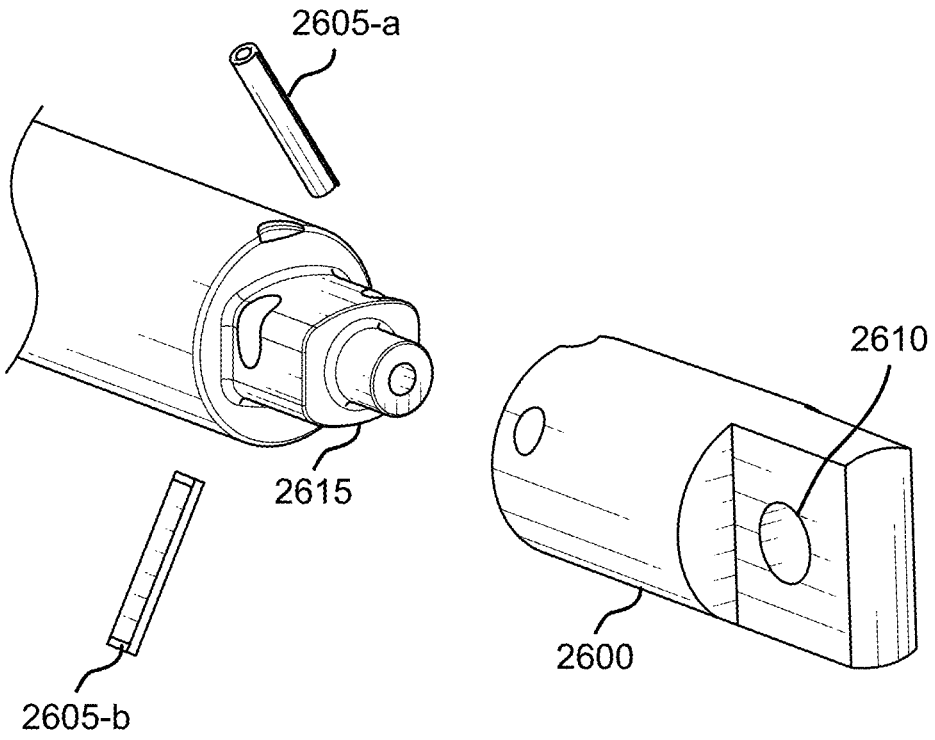
FIG. 26 shows an example of a portion of an apparatus for horizontal directional drilling having a threadless joint according to aspects of the present disclosure.

FIG. 26 shows an example of an exploded isometric view of a portion of an apparatus for horizontal directional drilling 2600 including a four-sided rounded polygon projection and mating pocket according to aspects of the present disclosure.

In one aspect, pocket 2600 includes pulling eye 2610 (as also described with reference to FIG. 25). In some cases, pulling eye 2610 is used for performing a pull back of a product pipe. For example, pulling eye 2610 is used to attach the product pipe with the drilling tool (such as drilling tool described with reference to FIGS. 7, 16, 19-10, and 22-23) to perform the pulling operation. Pocket 2600 is an example of, or includes aspects of, the corresponding element described with reference to FIGS. 8, 15, 16, 21-22, and 28. Pulling eye 2610 is an example of, or includes aspects of, the corresponding element described with reference to FIGS. 18, 25, 28, and 29.

In one aspect, pin 2605 is used to attach pocket 2600 comprising pulling eye 2610 to projection 2615. As shown in FIG. 26, pin 2605 includes pin 2605-*a* and pin 2605-*b*. For instance, pin 2605-*a* and pin 2605-*b* are arranged at an angle with each other. In some cases, projection 2615 is attached to elongated housing (such as elongated housing 2520 described with reference to FIG. 25). Projection 2615 is an example of, or includes aspects of, the corresponding element described with reference to FIGS. 1-3, 6, 14, 16, 18, 19, 23, and 24. Pin 2605 is an example of, or includes aspects of, the corresponding element described with reference to FIGS. 7, 14, 15, 19, 21, 23-25, and 27-29.

As previously described, the triangular feature may have a different cross-sectional shape. In the embodiment of FIG. 26, the cross-sectional shape is a four-sided rounded polygon. In the embodiment shown, two pins 2605-*a* and 2605-*b* are used to secure the four-sided projection to the pocket. In one aspect, each pin 2605-*a* 2605-*b* intersects one vertex of the four-sided projection. In the embodiment shown, the pins intersect adjacent vertices, although other embodiments, such as more than two pins, and/or pins intersecting non-adjacent vertices, are also contemplated.

FIG. 27 shows an example of a portion of an apparatus for horizontal directional drilling 2700 including a threadless joint according to aspects of the present disclosure. Threadless joint 2700 is an example of, or includes aspects of, the corresponding element described with reference to FIGS. 1-23, 25, 28, and 29.

Figure 27A:
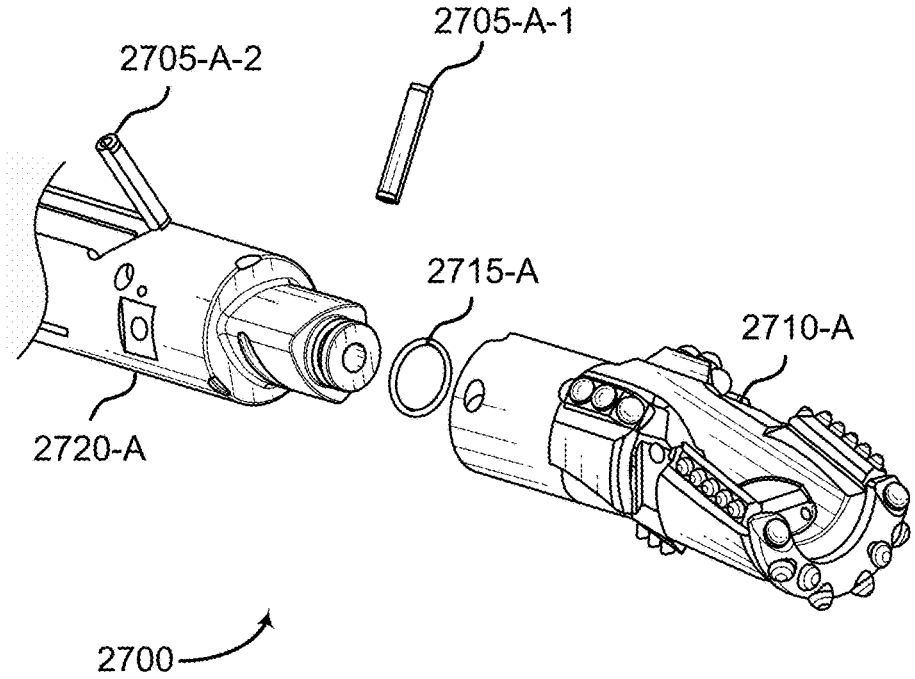
FIG. 27A is an example of an exploded isometric view of an implementation of a portion of an apparatus for horizontal directional drilling having a threadless joint according to aspects of the present disclosure.

In one aspect, portion of apparatus 2700 depicts a two-pin threadless joint and a three-pin threadless joint. In some cases, two-pin threadless joint depicted in FIG. 27A includes pin 2705-A, drilling tool 2710-A, o-ring 2715-A, and elongated housing 2720-A. In some aspects, FIG. 27A depicts pins 2705-A comprising a set of two pins, i.e., 2705-A-1 and 2705-A-2.

Figure 27B:
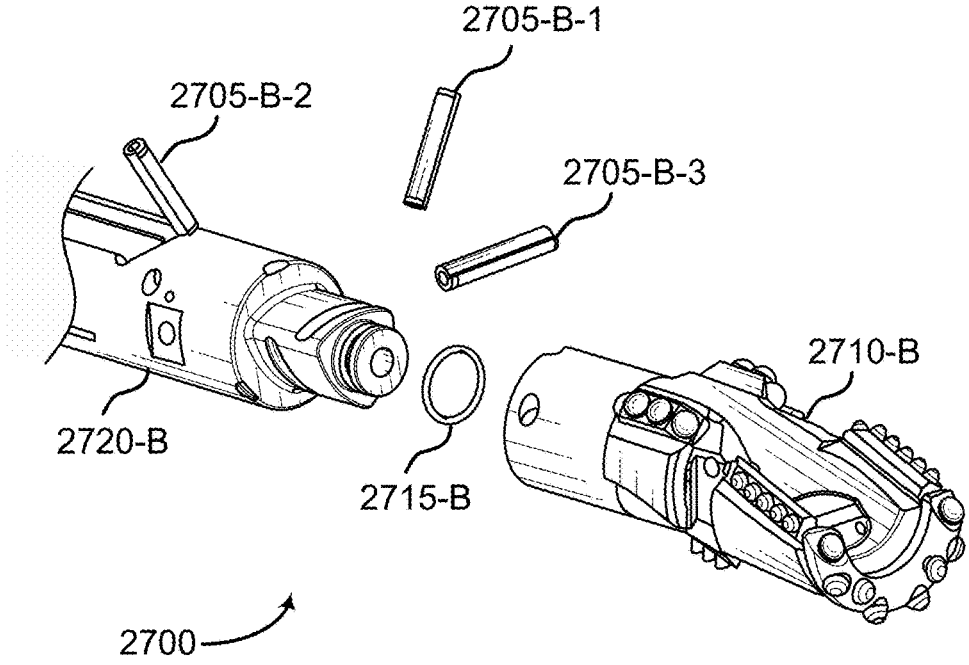
FIG. 27B is an example of an exploded isometric view of another implementation of a portion of an apparatus for horizontal directional drilling having a threadless joint according to aspects of the present disclosure.

In some cases, the three-pin threadless joint depicted in FIG. 27B includes pin 2705-B, drilling tool 2710-B, o-ring 2715-B, and elongated housing 2720-B. In some aspects, FIG. 27B depicts pins 2705-B comprising a set of three pins, i.e., 2705-B-1, 2705-B-2, and 2705-B-3. Pins 2705-A and 2705-B are an example of, or includes aspects of, the corresponding element described with reference to FIGS. 7, 14, 15, 19, 21, 23-26, 28, and 29.

As shown in FIG. 27, pins 2705-A (i.e., a set of 2 pins-2705-A-1 and 2705-A-2) are used to attach drilling tool 2710-A with elongated housing 2720-A. Additionally, as shown in FIG. 27, pins 2705-B (i.e., a set of 3 pins-2705-B-1, 2705-B-2, and 2705-B-3) are used to attach drilling tool 2710-B with elongated housing 2720-B. Drilling tool 2710 (such as drilling tool 2710-A and drilling tool 2710-B) is an example of, or includes aspects of, the corresponding element described with reference to FIGS. 7, 16, 19, 20, and 22.

In one aspect, o-ring 2715 (such as each of o-ring 2715-A and 2715-B) is used to seal water and debris out of the threadless joint. O-ring 2715 is an example of, or includes aspects of, the corresponding element described with reference to FIGS. 6, 19, and 23-25.

In some cases, elongated housing 2720 (such as each of elongated housing 2720-A and 2720-B) includes an interior region, a front region, a rear region, and a longitudinal axis extending from the front region to the rear region. Elongated housing 2720 is an example of, or includes aspects of, the corresponding element described with reference to FIGS. 1-3, 7, 19, 20, and 23-25.

Figure 28:
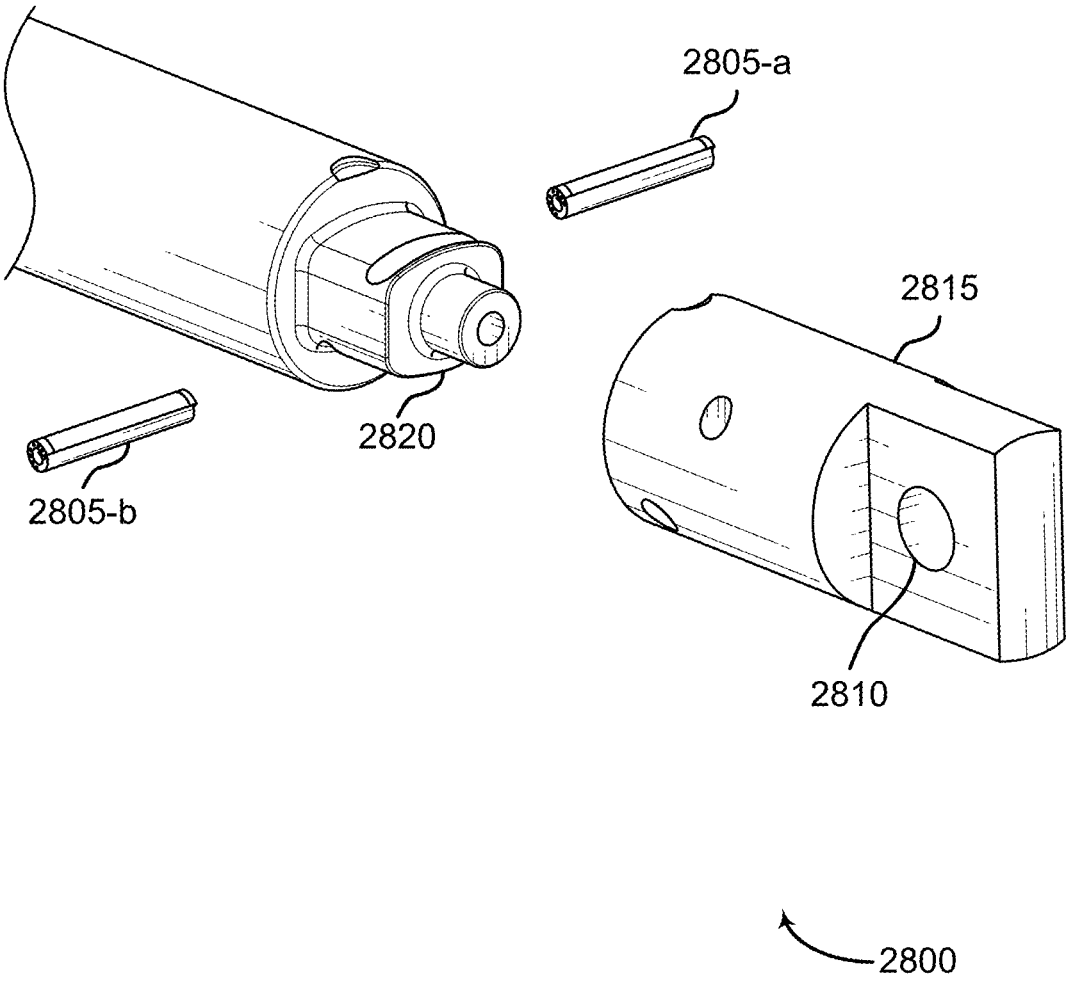
FIG. 28 is an example of an exploded isometric view of another implementation of a portion of an apparatus for horizontal directional drilling having a threadless joint according to aspects of the present disclosure.

FIG. 28 shows an example of a a portion of an apparatus for horizontal directional drilling 2800 including a threadless joint according to aspects of the present disclosure. Portion of apparatus for horizontal directional drilling 2800 is an example of, or includes aspects of, the corresponding element described with reference to FIGS. 1-23, 25, 27, and 29.

In one aspect, portion of apparatus 2800 depicts projection 2820 and female connector 2815 including a pocket (not shown). As shown in FIG. 28, projection 2820 includes pin 2805. Additionally, female connector 2815 is integrated with pulling eye 2810. Projection 2820 is an example of, or includes aspects of, the corresponding element described with reference to FIGS. 1-3, 6, 14, 16, 18, 19, 23-24, and 26.

In one aspect, pin 2805 is used to attach pocket of female connector 2815 to projection 2820, thus connecting pulling eye 2810 to projection 2820. As shown in FIG. 28, pin 2805 includes pin 2805-*a* and pin 2805-*b*. For instance, pin 2805-*a* and pin 2805-*b* are arranged parallel to each other. In some cases, projection 2820 is attached to elongated housing (such as elongated housing 2520 described with reference to FIG. 25). In some aspects, projection includes a four-sided rounded rectangular feature as shown in FIG. 28. Pin 2805 is an example of, or includes aspects of, the corresponding element described with reference to FIGS. 7, 14, 15, 19, 21, 23-27, and 29.

In one aspect, pulling eye 2810 is integrated with female connector 2815. In some cases, pulling eye 2610 is used for performing a pull back of a product pipe. For example, pulling eye 2810 is used to attach the product pipe with the drilling tool (such as drilling tool described with reference to FIGS. 7, 16, 19-10, and 22-23) to perform the pulling operation. Female connector 2815 having a pocket is an example of, or includes aspects of, the corresponding element described with reference to FIGS. 8, 15, 16, 21-22, and 26. Pulling eye 2810 is an example of, or includes aspects of, the corresponding element described with reference to FIGS. 18, 25, 26, and 29.

Figure 29A:
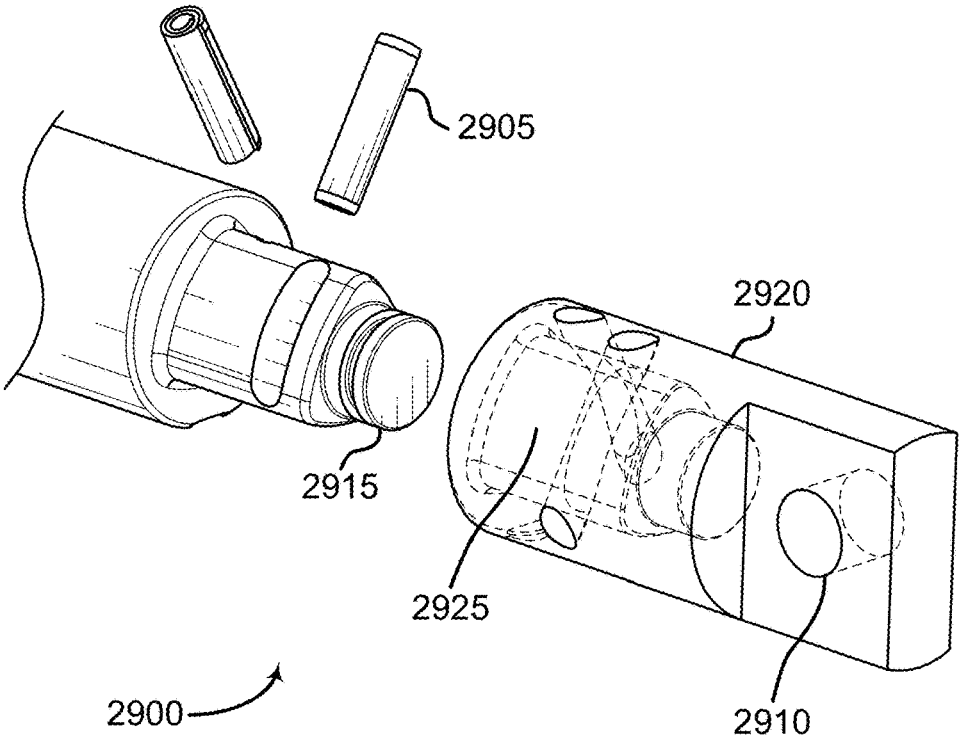
FIG. 29A is an example of an exploded isometric view of another implementation of a portion of an apparatus for horizontal directional drilling having a threadless joint according to aspects of the present disclosure.
Figure 29B:
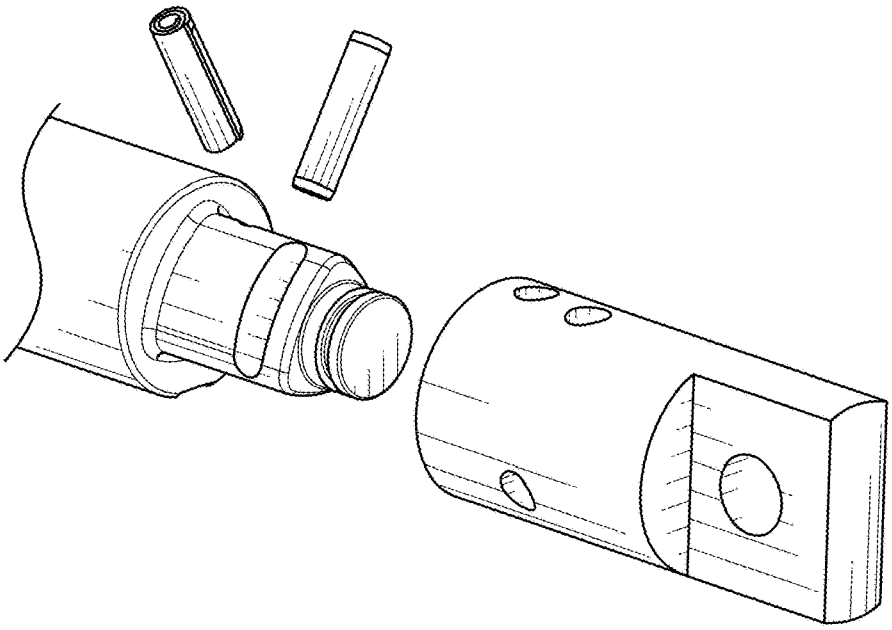
FIG. 29B is an example of an exploded isometric view of another implementation of a portion of an apparatus for horizontal directional drilling having a threadless joint according to aspects of the present disclosure.

FIG. 29 shows an example of a portion of an apparatus for horizontal directional drilling 2900 including a threadless joint according to aspects of the present disclosure. Portion of apparatus 2900 is an example of, or includes aspects of, the corresponding element described with reference to FIGS. 1-23, 25, 27, and 28.

In one aspect, portion of apparatus 2900 includes projection 2915 and female connector 2920 having pocket 2925. In some cases, projection 2915 includes pin 2905. Projection 2915 is an example of, or includes aspects of, the corresponding element described with reference to FIGS. 1-3, 6, 14, 16, 18, 19, 23-24, and 26-27. Pin 2905 is an example of, or includes aspects of, the corresponding element described with reference to FIGS. 7, 14, 15, 19, 21, and 23-28.

In some cases, female connector 2920 is integrated with pulling eye 2910. In some cases, female connector 2920 comprises a pocket. Female connector 2920 is an example of, or includes aspects of, the corresponding element described with reference to FIGS. 8, 15, 16, 21-22, and 26-27. Pulling eye 2910 is an example of, or includes aspects of, the corresponding element described with reference to FIGS. 18, 25, 26, and 28.

Accordingly, an apparatus for directional drilling apparatus is described. One or more aspects of the apparatus include an elongated housing including an interior, a front, a rear, and a longitudinal axis passing through the front and rear; a sonde transmitter mounted in the interior; a main fluid channel extending in the interior of the housing in a direction along the longitudinal axis to permit a flow of a fluid therethrough; a drilling tool; and a connecting region for attaching the drilling tool to the elongated housing, wherein the connecting region comprises a projection and a pocket, at least a portion of the projection being a mating rounded polygon, the pocket being shaped and sized to mate with the projection, and wherein the mating rounded polygon is configured to transmit torque between the transmitter housing and the drilling tool, wherein the projection is located on one of the elongated housing and the drilling tool, and the pocket is located on the other of the elongated housing and the drilling tool.

In some aspects, the sonde transmitter is configured to transmit data related to the position and orientation of the drilling tool. In some aspects, the connecting region further comprises a locking mechanism to secure the drilling tool to the housing.

In some aspects, the locking mechanism comprises removable pins designed to intersect a portion of the perimeter of the rounded polygon, thereby securing the drilling tool to the housing. In some aspects, the removable pins are configured to intersect at least one side of the rounded polygon, ensuring a secure connection between the projection and the pocket. In some aspects, the locking mechanism includes a spring pin to provide additional resilience and maintain the connection under varying loads. In some aspects, the locking mechanism includes a solid pin to enhance shear strength and withstand high-impact forces during drilling operations. In some aspects, the removable pins are positioned to intersect the vertices of the rounded polygon, optimizing the distribution of torque and reducing wear on the connection.

In some aspects, the drilling tool includes cutting edges made of a wear-resistant material to improve the efficiency of the drilling process.

In some aspects, the connecting region is designed to allow quick attachment and detachment of the drilling tool without the need for specialized tools. In some aspects, the mating rounded polygon of the connecting region is a three-lobed epitrochoid to enhance the transfer of torque. In some aspects, to remove one drilling tool, a hammer and a punch are used to drive out the pins attaching the drilling tool to the sonde housing. The drilling tool is slid off and removed. The drilling tool being attached is slid on. Then a hammer is used to reinstall the pins to secure the drilling tool to the sonde housing.

In some aspects, the projection is located on the elongated housing, and the pocket is located on the drilling tool. In some aspects, the projection is located on the drilling tool, and the pocket is located on the elongated housing.

A Drilling Process

Figure 30:
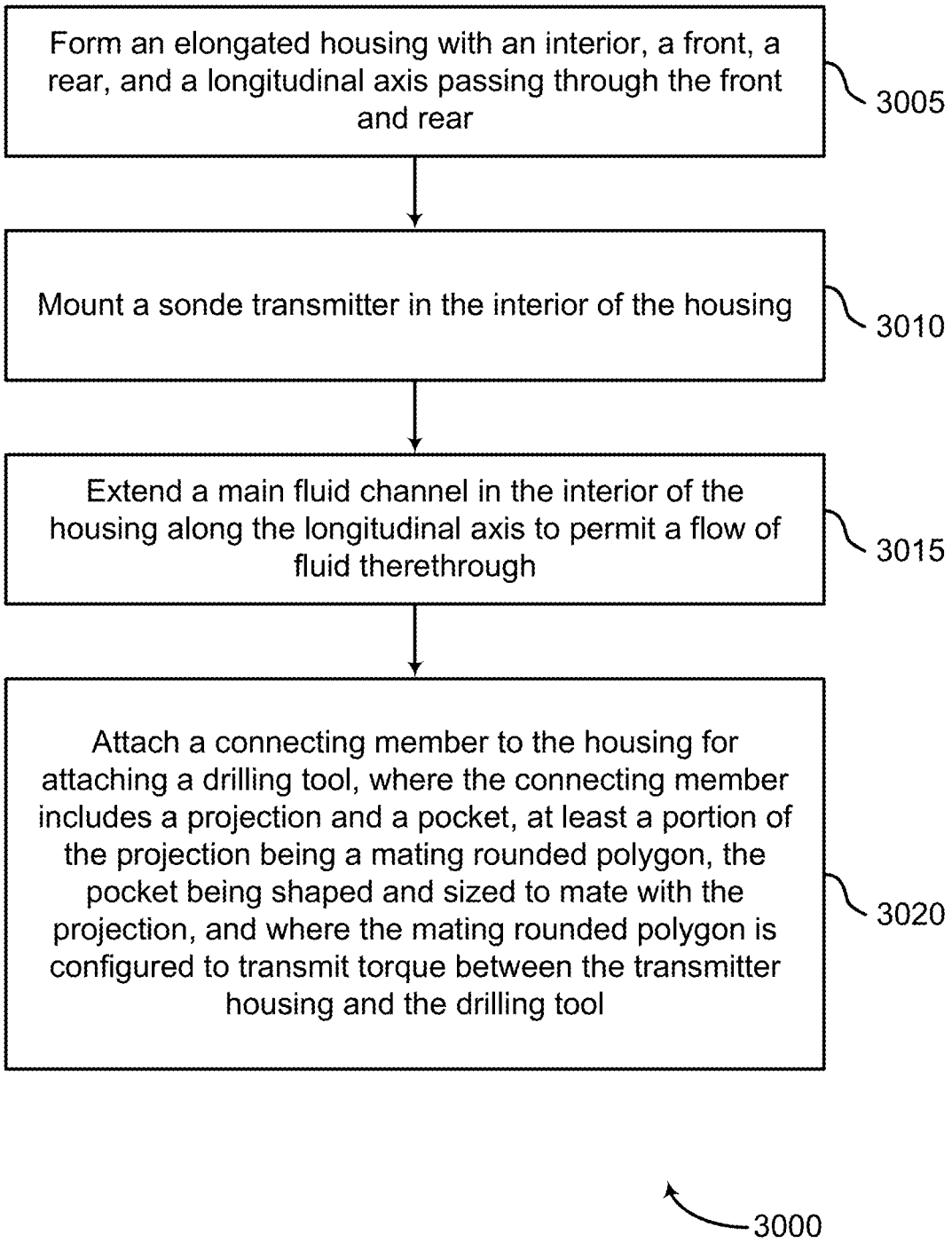
FIG. 30 shows an example of a method for drilling systems according to aspects of the present disclosure.

FIG. 30 shows an example of a method 3000 for drilling systems according to aspects of the present disclosure. Additionally or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 3005, the method forms an elongated housing with an interior, a front, a rear, and a longitudinal axis passing through the front and rear. In some cases, the operations of this step refer to, or may be performed by, a threadless joint as described with reference to FIGS. 1-23, 25, 27-28, and 29.

At operation 3010, the method mounts a sonde transmitter in the interior of the housing. In some cases, the operations of this step refer to, or may be performed by, a threadless joint as described with reference to FIGS. 1-23, 25, 27-28, and 29.

At operation 3015, the method extends a main fluid channel in the interior of the housing along the longitudinal axis to permit a flow of fluid therethrough. In some cases, the operations of this step refer to, or may be performed by, a threadless joint as described with reference to FIGS. 1-23, 25, 27-28, and 29.

At operation 3020, the method attaches a connecting member to the housing for attaching a drilling tool, where the connecting member includes a projection and a pocket, at least a portion of the projection being a mating rounded polygon, the pocket being shaped and sized to mate with the projection, and where the mating rounded polygon is configured to transmit torque between the transmitter housing and the drilling tool. In some cases, the operations of this step refer to, or may be performed by, a threadless joint as described with reference to FIGS. 1-23, 25, 27-28, and 29.

Accordingly, a method for directional drilling apparatus is described. One or more aspects of the method include forming an elongated housing with an interior, a front, a rear, and a longitudinal axis passing through the front and rear; mounting a sonde transmitter in the interior of the housing; extending a main fluid channel in the interior of the housing along the longitudinal axis to permit a flow of fluid therethrough; and attaching a connecting member to the housing for attaching a drilling tool, wherein the connecting member comprises a projection and a pocket, at least a portion of the projection being a mating rounded polygon, the pocket being shaped and sized to mate with the projection, and wherein the mating rounded polygon is configured to transmit torque between the transmitter housing and the drilling tool. In some aspects, the sonde transmitter is configured to transmit data related to the position and orientation of the drilling tool.

In some aspects, the attaching of the connecting member comprises attaching the projection located on the elongated housing to the pocket is located on the drilling tool. In some aspects, the connecting member further comprises a locking mechanism to secure the drilling tool to the housing.

In some aspects, the locking mechanism comprises removable pins designed to intersect a portion of the perimeter of the rounded polygon, thereby securing the drilling tool to the housing. In some aspects, the removable pins are configured to intersect at least one side of the rounded polygon, ensuring a secure connection between the projection and the pocket. In some aspects, the locking mechanism includes a spring pin to provide additional resilience and maintain the connection under varying loads. In some aspects, the locking mechanism includes a solid pin to enhance shear strength and withstand high-impact forces during drilling operations. In some aspects, the removable pins are positioned to intersect the vertices of the rounded polygon, optimizing the distribution of torque and reducing wear on the connection.

Some examples of the method, apparatus, and system further include forming cutting edges on the drilling tool made of a wear-resistant material to improve the efficiency of the drilling process. In some aspects, the connecting member is designed to allow quick attachment and detachment of the drilling tool without the need for specialized tools.

In some aspects, the rounded polygon of the connecting member is a three-lobed epitrochoid to enhance the transfer of torque. In some aspects, the attaching of the connecting member comprises attaching the projection located on the drilling tool to the pocket is located on the elongated housing.

While only a few embodiments of the disclosure have been shown and described, it will be obvious to those skilled in the art that many changes and modifications may be made thereunto without departing from the spirit and scope of the disclosure as described in the following claims.

In describing example embodiments, specific terminology is used for the sake of clarity. For purposes of description, each specific term is intended to at least include all technical and functional equivalents that operate in a similar manner to accomplish a similar purpose. Additionally, in some instances where a particular example embodiment includes system elements, device components or method steps, those elements, components or steps can be replaced with a single element, component or step. Likewise, a single element, component or step can be replaced with a plurality of elements, components or steps that serve the same purpose. Moreover, while example embodiments have been shown and described with references to particular embodiments thereof, those of ordinary skill in the art will understand that various substitutions and alterations in form and detail can be made therein without departing from the scope of the disclosure. Further still, other aspects, functions and advantages are also within the scope of the disclosure.

Example flowcharts are provided herein for illustrative purposes and are non-limiting examples of methods. One of ordinary skill in the art will recognize that example methods can include more or fewer steps than those illustrated in the example flowcharts, and that the steps in the example flowcharts can be performed in a different order than the order shown in the illustrative flowcharts.

While the disclosure has been disclosed in connection with the preferred embodiments shown and described in detail, various modifications and improvements thereon will become readily apparent to those skilled in the art. Accordingly, the spirit and scope of the disclosure is not to be limited by the foregoing examples, but is to be understood in the broadest sense allowable by law.

The use of the terms "a" and "an" and "the" and similar referents in the context of describing the disclosure (especially in the context of the following claims) is to be construed to cover both the singular and the plural, unless otherwise indicated herein or clearly contradicted by context. The terms "comprising," "with," "including," and "containing" are to be construed as open-ended terms (i.e., meaning "including, but not limited to,") unless otherwise noted. Recitations of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. The term "set" may include a set with a single member. No language in the specification should be construed as indicating any non-claimed element as essential to the practice of the disclosure.

While the foregoing written description enables one skilled to make and use what is considered presently to be the best mode thereof, those skilled in the art will understand and appreciate the existence of variations, combinations, and equivalents of the specific embodiment, method, and examples herein. The disclosure should therefore not be limited by the above-described embodiment, method, and examples, but by all embodiments and methods within the scope and spirit of the disclosure.

All patent applications and patents, both foreign and domestic, and all other publications references herein are incorporated herein in their entireties to the full extent permitted by law.

While the invention herein disclosed has been described by means of specific embodiments, examples and applications thereof, numerous modifications and variations could be made thereto by those skilled in the art without departing from the scope of the invention set forth in the claims.

What is claimed is:

1. An apparatus for horizontal directional drilling comprising:

an elongated housing including an interior, a front, a rear, and a longitudinal axis passing through the front and rear;

a sonde transmitter mounted in the interior;

a main fluid channel extending in the interior of the housing in a direction along the longitudinal axis to permit a flow of a fluid therethrough;

a drilling tool; and a connecting region attaching the drilling tool to the front of the elongated housing, wherein the connecting region comprises a projection coupled to a pocket, at least a portion of the projection being a mating rounded polygon, wherein the mating rounded polygon is a three-lobed epitrochoid, the pocket being shaped and sized to mate with the projection, and wherein the mating rounded polygon is configured to transmit torque between the elongated housing and the drilling tool;

wherein the projection is located on one of the elongated housing and the drilling tool, and the pocket is located on the other of the elongated housing and the drilling tool.

2. The apparatus of claim 1, wherein the connecting region further comprises a locking mechanism to secure the drilling tool to the housing.

3. The apparatus of claim 2, wherein the locking mechanism comprises removable pins each intersecting a portion of the perimeter of the rounded polygon, thereby securing the drilling tool to the housing.

4. The apparatus of claim 3, wherein the connecting region is configured such that each removable pin intersects at least one side of the rounded polygon.

5. The apparatus of claim 3, wherein the locking mechanism includes a spring pin.

6. The apparatus of claim 3, wherein the locking mechanism includes a solid pin.

7. The apparatus of claim 3, wherein the connecting region is configured such that each removable pin intersects at least one vertex of the rounded polygon.

8. The apparatus of claim 1, wherein the drilling tool includes cutting edges made of a wear-resistant material.

9. The apparatus of claim 1, wherein the connecting region is configured for attachment and detachment of the drilling tool without the need for specialized tools.

10. The apparatus of claim 1, wherein the projection is located on the elongated housing, and the pocket is located on the drilling tool.

11. The apparatus of claim 1, wherein the projection is located on the drilling tool, and the pocket is located on the elongated housing.

12. A method for making an apparatus for horizontal directional drilling, comprising:

forming an elongated housing with an interior, a front, a rear, and a longitudinal axis passing through the front and rear;

mounting a sonde transmitter in the interior of the housing;

extending a main fluid channel in the interior of the housing along the longitudinal axis to permit a flow of fluid therethrough; and attaching a drilling tool to the front of the elongated housing by using a connecting region, wherein the connecting region comprises a projection located on one of the front of the elongated housing and the drilling tool and a pocket located on the other of the front of the elongated housing and the drilling tool, at least a portion of the projection being a mating rounded polygon, wherein the rounded polygon is a three-lobed epitrochoid, the pocket being shaped and sized to mate with the projection, and wherein the mating rounded polygon is configured to transmit torque between the elongated housing and the drilling tool.

13. The method of claim 12, wherein the connecting region further comprises a locking mechanism to secure the drilling tool to the housing.

14. The method of claim 13, wherein the locking mechanism comprises removable pins each intersecting a portion of the perimeter of the rounded polygon, thereby securing the drilling tool to the housing.

15. The method of claim 14, wherein the connecting region is configured such that each removable pin intersects at least one side of the rounded polygon.

16. The method of claim 14, wherein the locking mechanism includes a spring pin.

17. The method of claim 14, wherein the locking mechanism includes a solid pin.

18. The method of claim 14, wherein the connecting region is configured such that each removable pin intersects at least one vertex of the rounded polygon.

19. The method of claim 12, further comprising forming cutting edges on the drilling tool made of a wear-resistant material.

20. The method of claim 12, wherein the connecting region is configured for attachment and detachment of the drilling tool without the need for specialized tools.

21. The method of claim 12, wherein said attaching of said connecting region comprises attaching the projection located on the elongated housing to the pocket located on the drilling tool.

22. The method of claim 12, wherein said attaching of said connecting region comprises attaching the projection located on the drilling tool to the pocket located on the elongated housing.

* * * * *